US006675462B1

(12) United States Patent
Takahashi

(10) Patent No.: US 6,675,462 B1
(45) Date of Patent: Jan. 13, 2004

(54) METHOD OF MANUFACTURING A MULTI-LAMINATED INDUCTOR

(75) Inventor: Osamu Takahashi, Tokyo (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 479 days.

(21) Appl. No.: 09/635,222

(22) Filed: Aug. 10, 2000

Related U.S. Application Data

(62) Division of application No. 09/299,742, filed on Apr. 27, 1999, now Pat. No. 6,154,114.

(30) Foreign Application Priority Data

May 1, 1998 (JP) ..... 10-121944

(51) Int. Cl.[7] ..... H01F 7/06; H01F 3/04; H01C 10/50

(52) U.S. Cl. ..... 29/602.1; 29/606; 29/609; 336/200

(58) Field of Search ..... 29/25.41, 25.42, 29/851, 602.1, 606, 609; 156/89.12, 89.16; 336/200, 223, 232

(56) References Cited

U.S. PATENT DOCUMENTS

| | | | | |
|---|---|---|---|---|
| 4,801,912 A | | 1/1989 | McElheny et al. | |
| 5,051,712 A | | 9/1991 | Naito et al. | |
| 5,578,981 A | | 11/1996 | Tokuda | |
| 5,655,287 A | | 8/1997 | Ushiro | |
| 6,218,925 B1 | * | 4/2001 | Iwao | 336/200 |
| 6,304,164 B1 | * | 10/2001 | Ohno et al. | 336/200 |
| 6,480,087 B1 | * | 11/2002 | Oiwa et al. | 336/200 |

FOREIGN PATENT DOCUMENTS

| | | | |
|---|---|---|---|
| JP | 6-96953 A | 4/1994 | |
| JP | 8-55726 | 2/1996 | |
| JP | 9-129447 | 5/1997 | |
| JP | 11-135309 | * 10/1997 | H01C/10/32 |

* cited by examiner

*Primary Examiner*—Carl J. Arbes
*Assistant Examiner*—Thiem Dinh Phan
(74) *Attorney, Agent, or Firm*—Lowe Hauptman Gilman & Berner, LLP

(57) ABSTRACT

A multi-laminated chip inductor (10) comprising a chip (11) provided therein with a coil (12) made by laminating insulating material sheets having internal conductors (21*a*) formed thereon and connecting the internal conductors (21*a*) into a helical shape and with lead internal conductors (22*a* through 25*a*) making connection between ends of the coil (12) and external terminal electrodes, and having external terminal electrodes (13*a* and 13*b*) formed on the surface of the chip (11) parallel to the winding center-line of the coil (12). Thereby, as the magnetic flux generated by the coil (12) does not intersect the plane of the external terminal electrodes (13*a*, 13*b*), eddy current within the external terminal electrodes (13*a*, 13*b*) can be prevented from generating and, the inductance values can be changed easily, by changing the connection position of the lead internal conductors (22*a* through 25*a*) with a coil end.

4 Claims, 24 Drawing Sheets

PRIOR ART

*Fig.* 3

PRIOR ART

*Fig.* 5

PRIOR ART

*Fig.* 6

*Fig.* 8 a
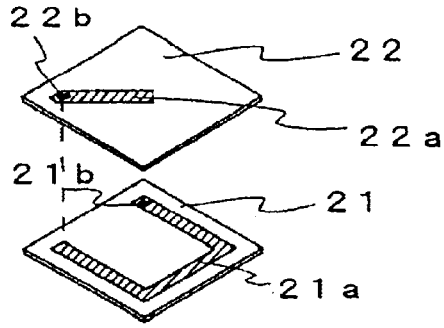
*Fig.* 8 b
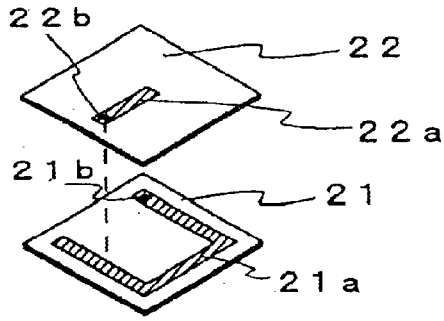
*Fig.* 8 c
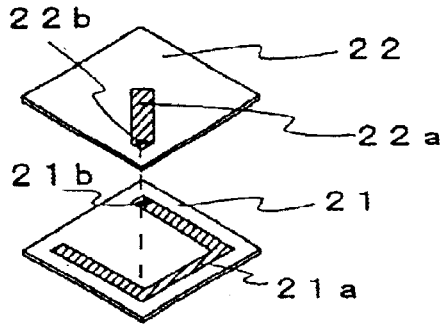

*Fig.* 8 d
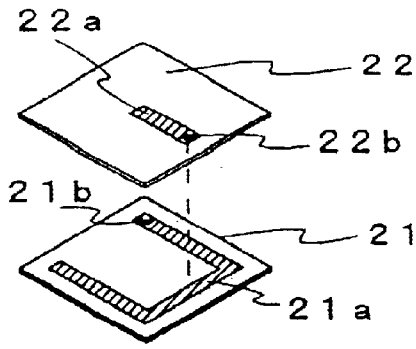
*Fig.* 8 e
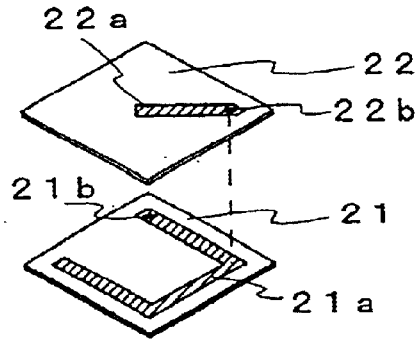
*Fig.* 8 f
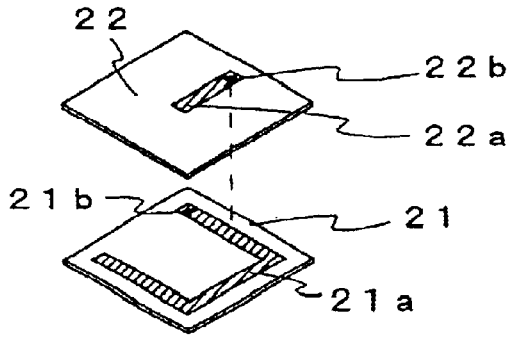

*Fig.* 8 g
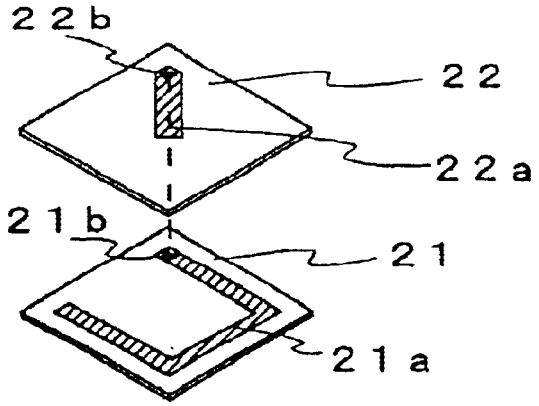
*Fig.* 9
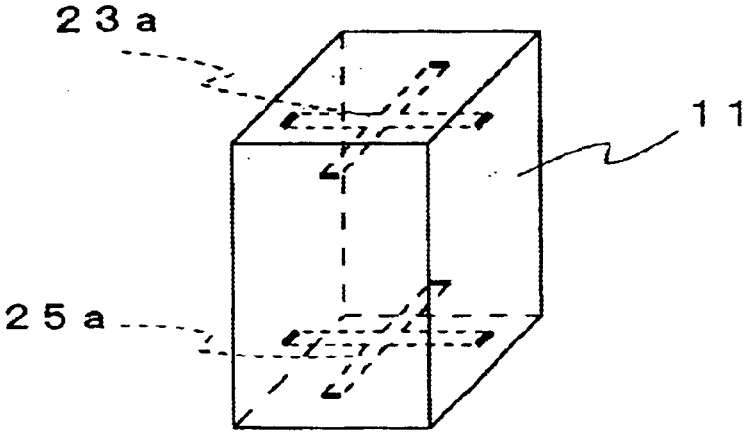

*Fig.* 10
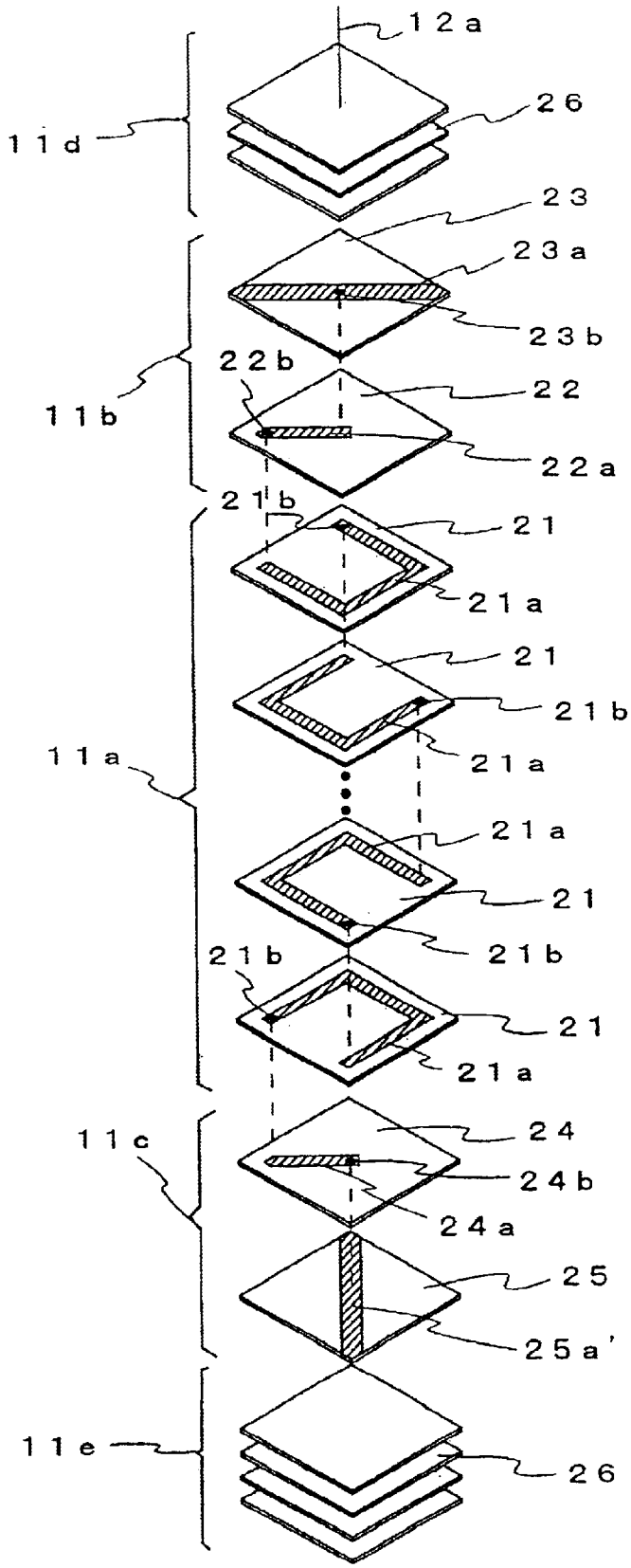

*Fig.* 11
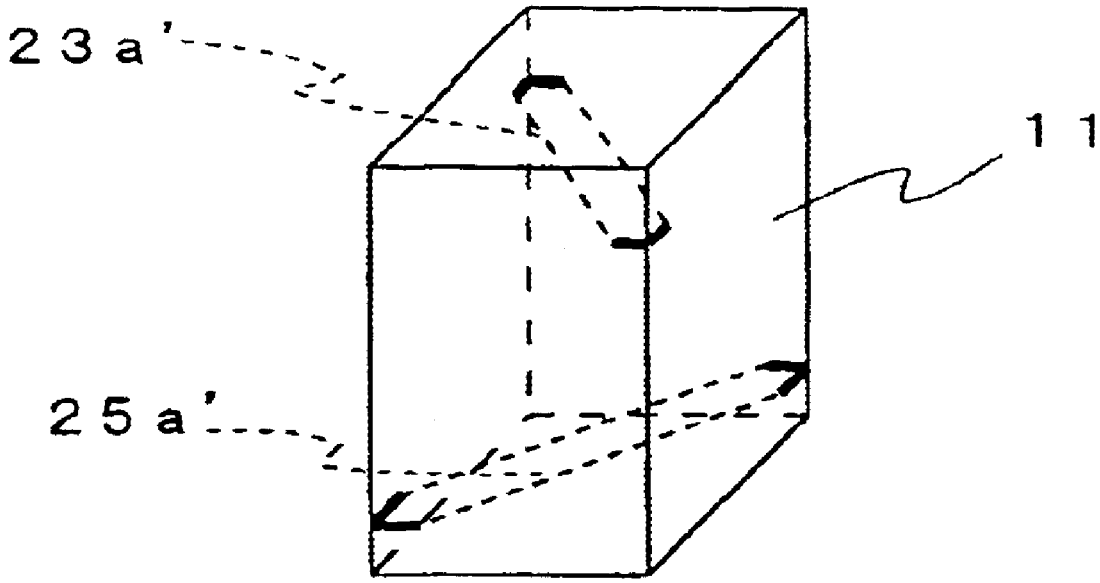

*Fig.* 12
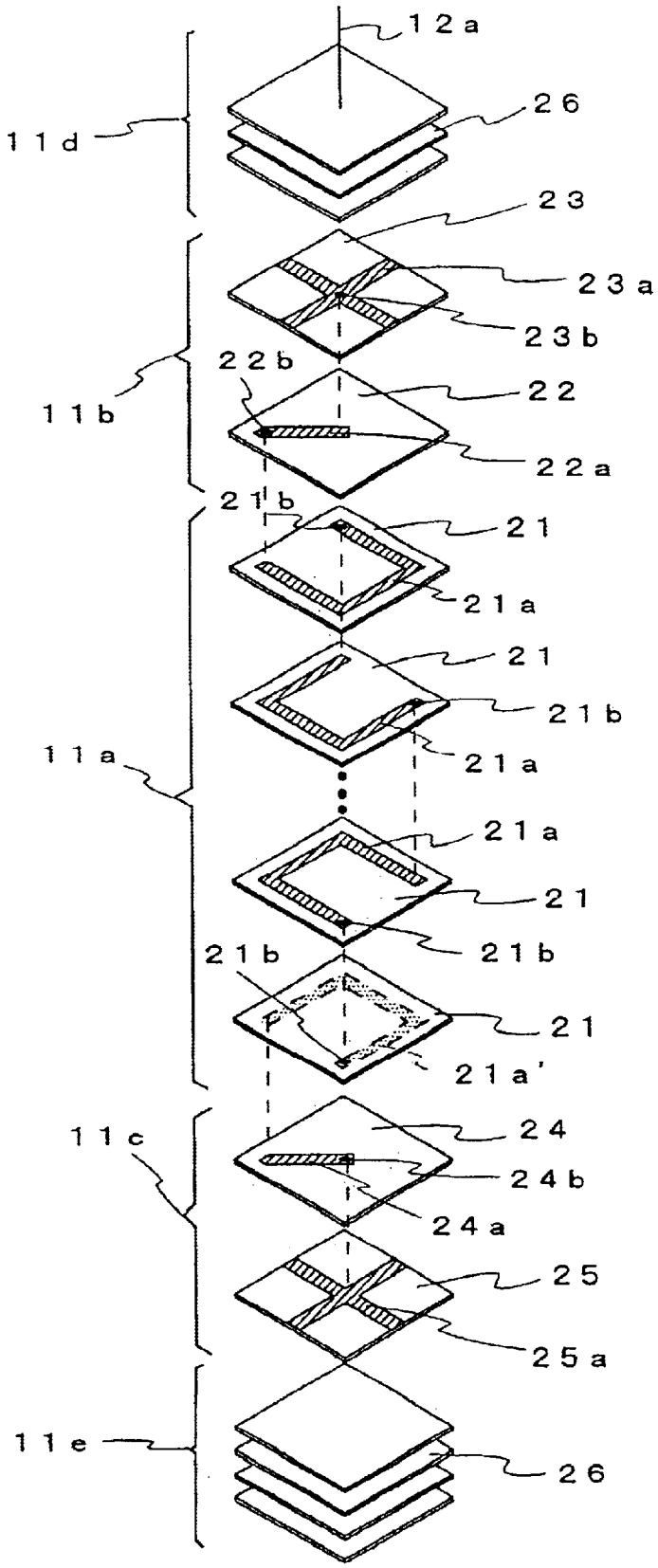

*Fig.* 13 a
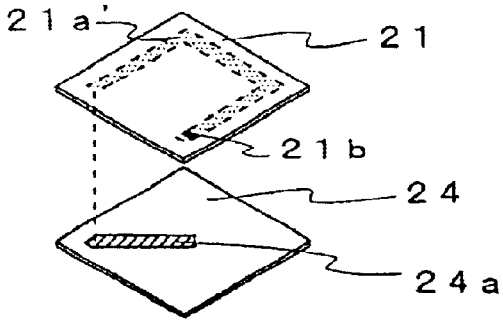
*Fig.* 13 b
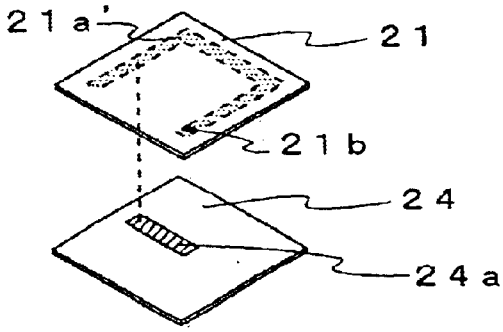
*Fig.* 13 c
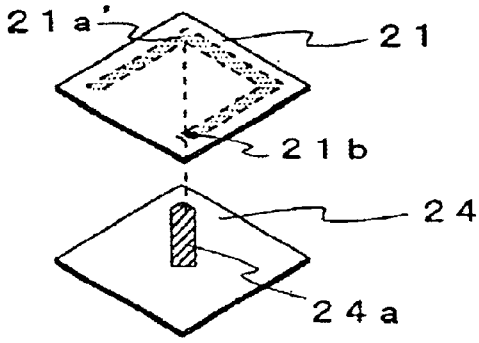

*Fig.* 13 d
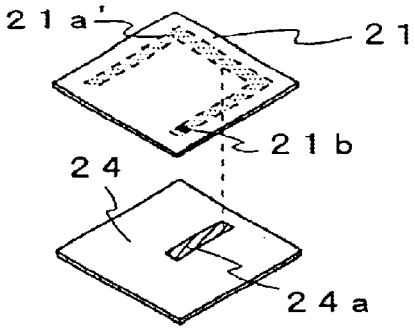
*Fig.* 13 e
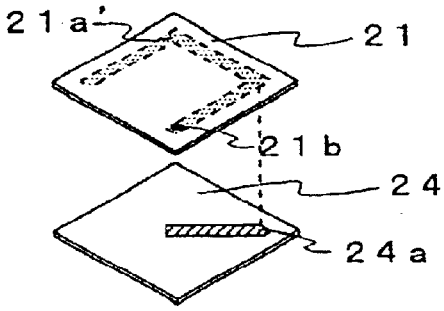
*Fig.* 13 f
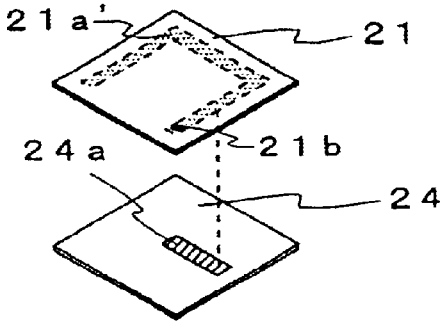

*Fig.* 14
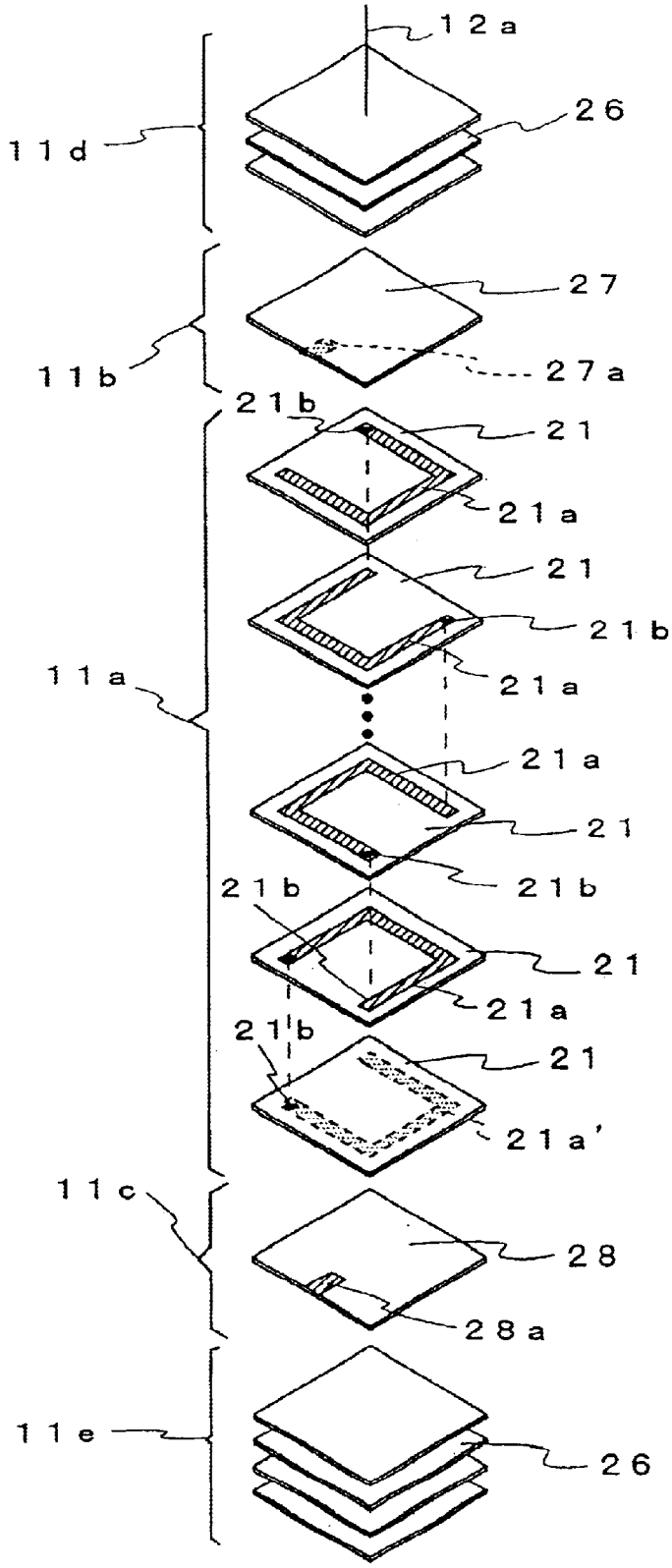

*Fig.* 15
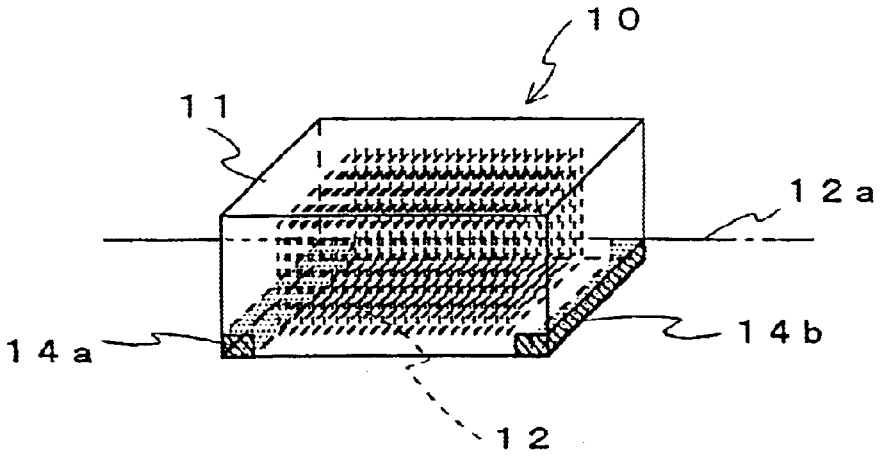
*Fig.* 16
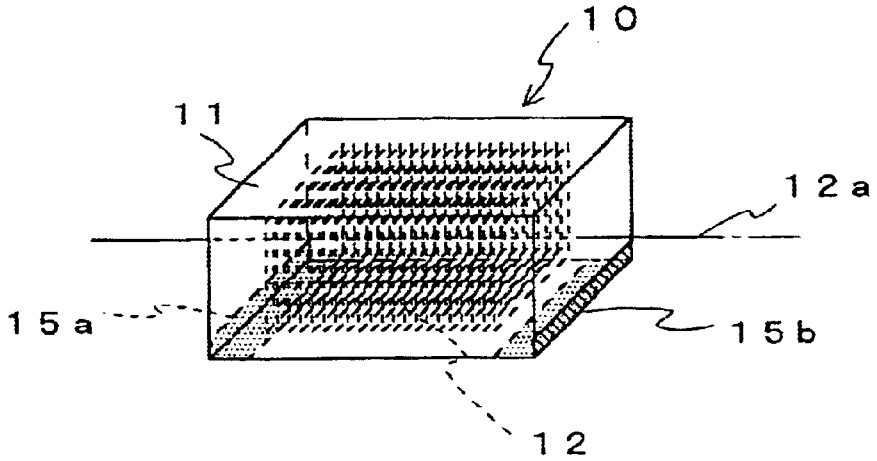

*Fig.* 17
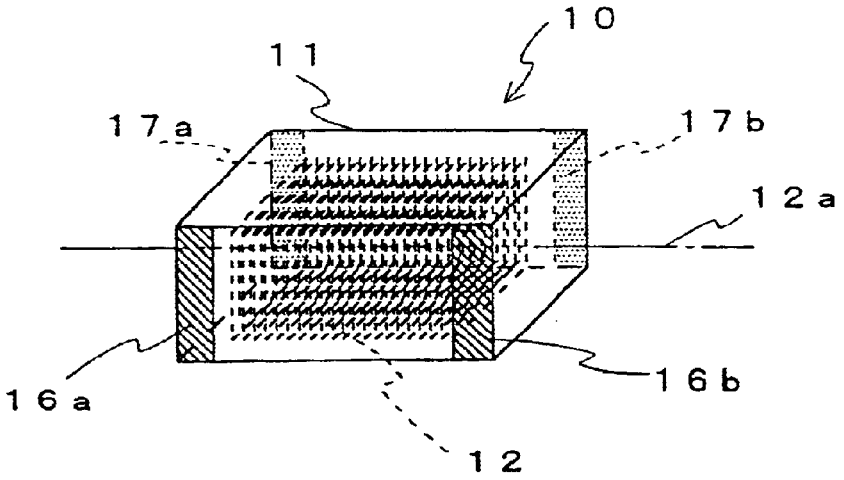
*Fig.* 18
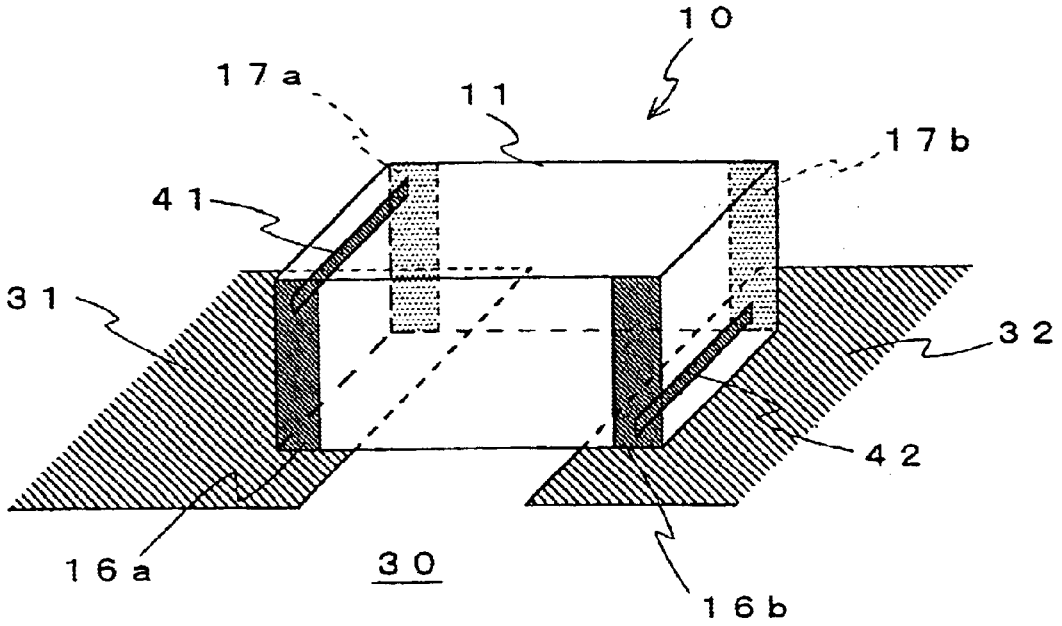

*Fig.* 19a
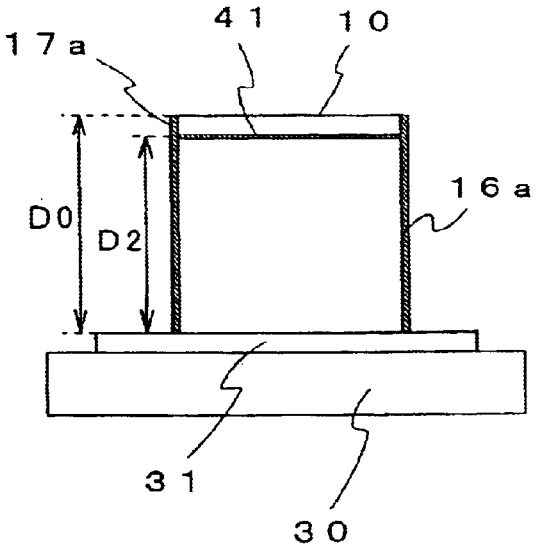
*Fig.* 19b
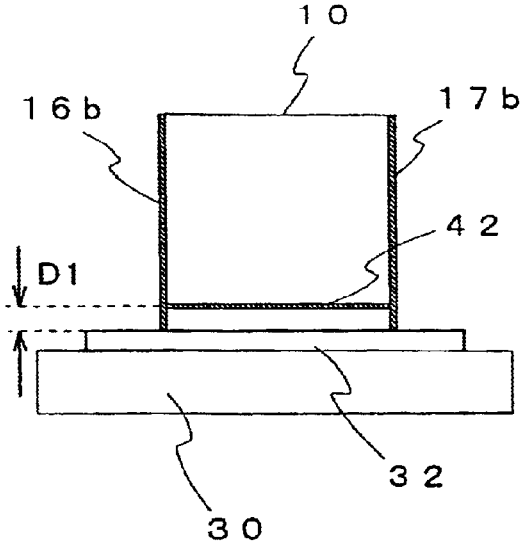
*Fig.* 20a
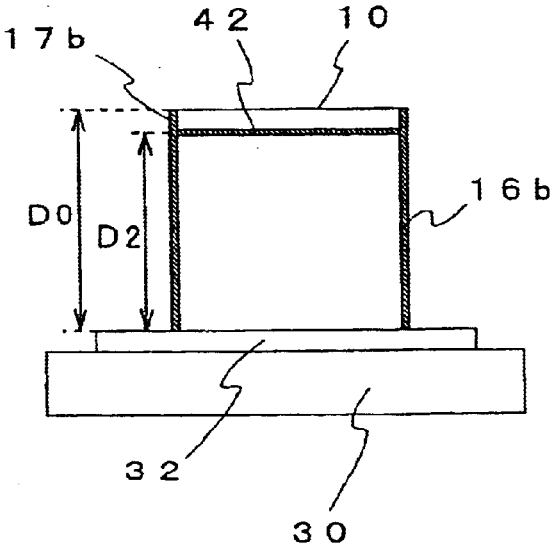
*Fig.* 20b
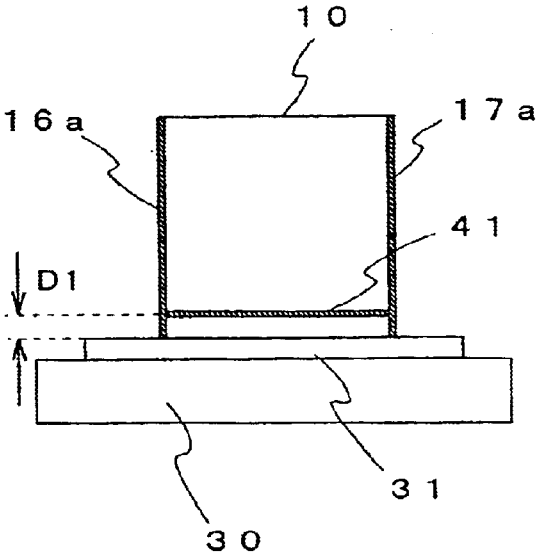

*Fig.* 21
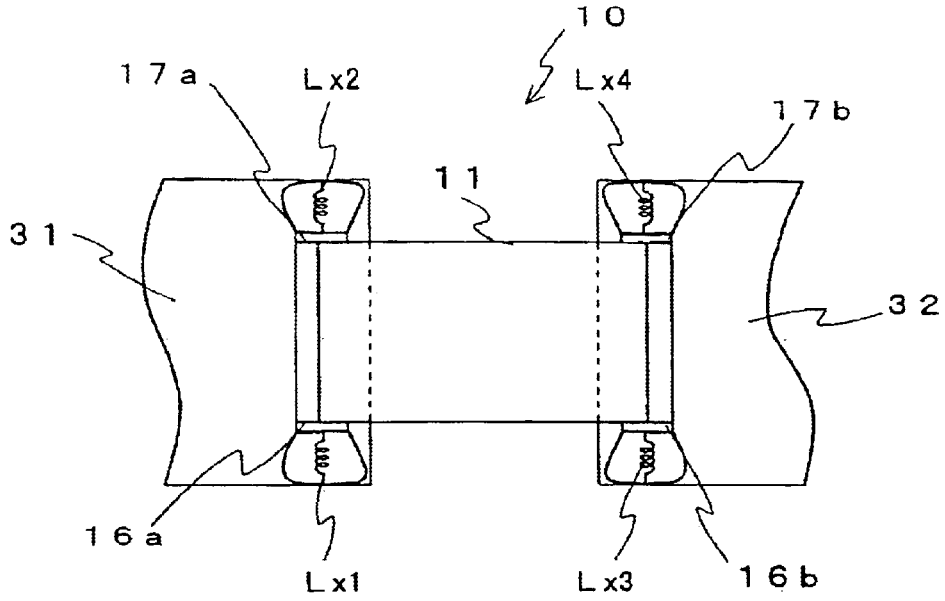
*Fig.* 22
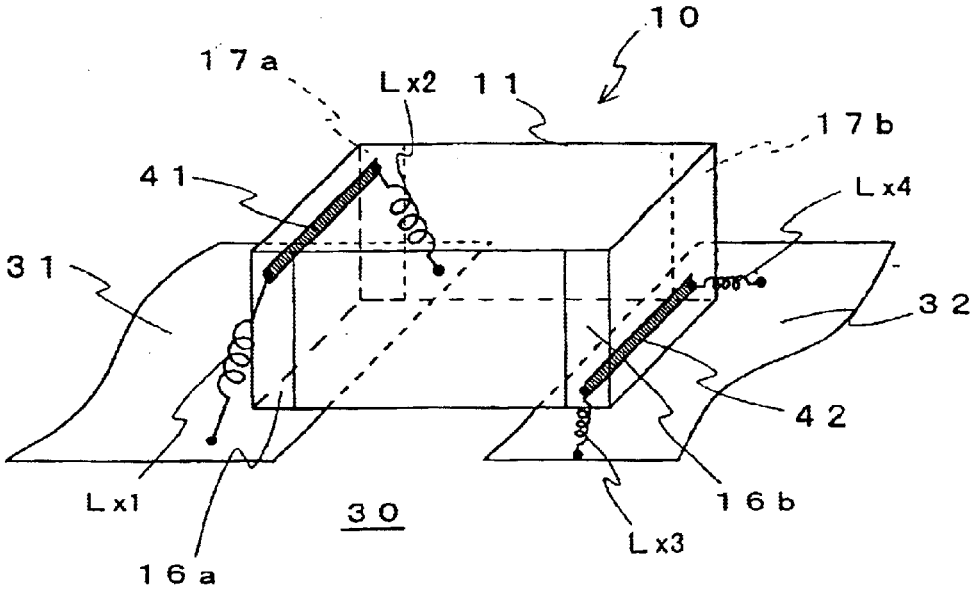

*Fig.* 25
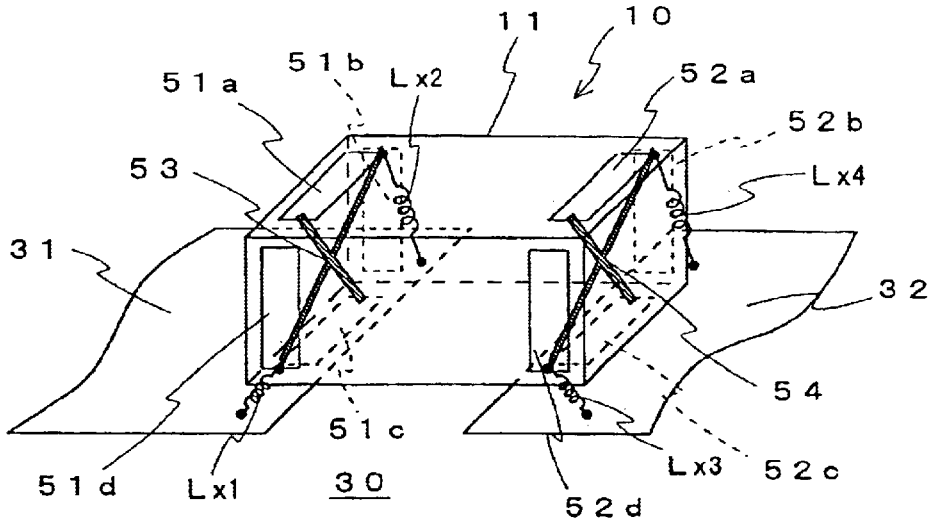
*Fig.* 26
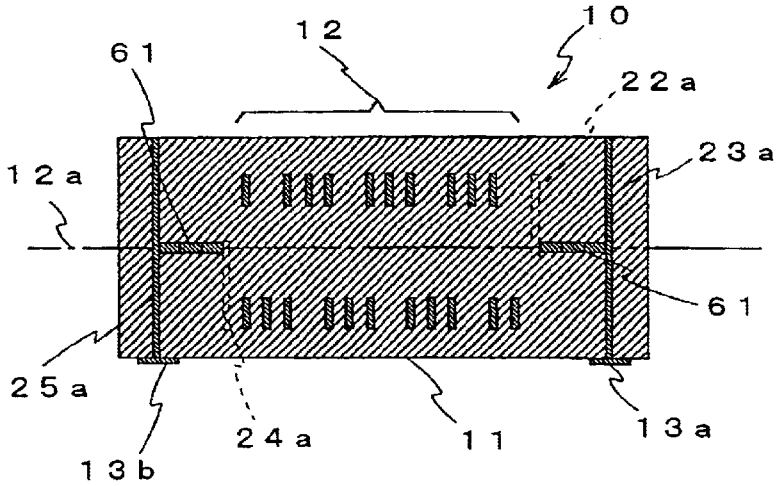

*Fig.* 27
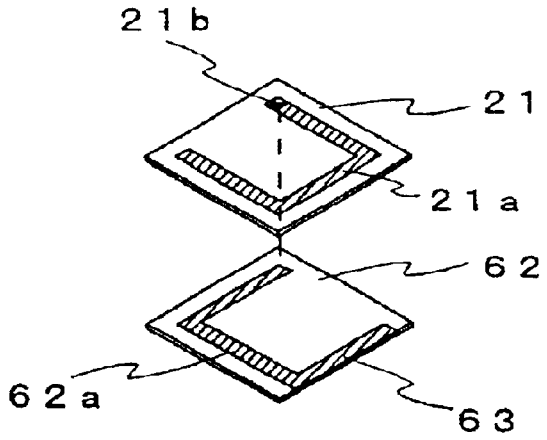
*Fig.* 28
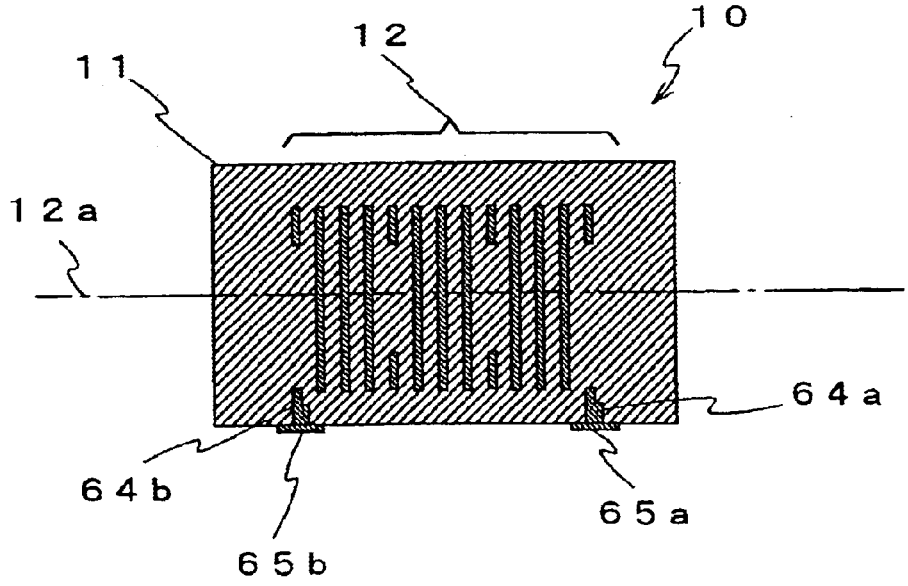

METHOD OF MANUFACTURING A MULTI-LAMINATED INDUCTOR

"CROSS REFERENCE TO RELATED DOCUMENT

The present application is a division of application Ser. No. 09/299,742, now U.S. Pat. No. 6,154,114 which was filed on Apr. 27, 1999."

BACKGROUND OF THE INVENTION

1. Field of the Invention

The present invention relates to a multi-laminated inductor used for various circuits and a manufacturing method and more particularly to a multi-laminated inductor comprised of laminated internal conductors forming a coil along the length of the chip.

2. Description of the Related Art

Conventional multi-laminated inductors are classified into two broad categories in the relation between the direction of laminating internal conductors and the outside shape of the chip, which form the coil. For example, multi-laminated chip inductors have such a structure that coil-shaped internal conductors made of silver or silver-palladium alloy are contained in a nonconductor material or ferrite magnetic material and both ends of the coil are connected to external terminal conductors respectively.

FIG. 2 shows a relation between the direction of laminating internal conductors and the outside shape of the chip in this type of multi-laminated chip inductors. It has one structure that the internal conductors 2 are laminated along the thickness Lt (or width Lw) of the multi-laminated chip inductor 1. Usual multi-laminated chip inductors have this structure. Here, the both ends of a coil-shaped conductor are connected to external terminal conductors 3*a* and 3*b*, respectively.

On the other hand, Japanese Patent Application Laid-Open No. 8-55726 teaches the another structure of a multi-laminated chip inductor 6 as shown in FIG. 3. That is, internal conductors 4 are laminated along the length L1 of the chip 6 and are external terminal conductors 5*a* and 5*b* formed at both end portions along its length.

This structure is generally referred to as a longitudinal stack type, and has features that it can provide relatively high inductance values and high self-resonance frequencies.

multi-laminated chip inductor of the longitudinal stack type, which has been developed applicant's assignee and is of a type disclosed in the co-pending, commonly assigned Ohno et al application, Ser. No. 09/240,699, filed Feb. 2, 1999, now U.S. Pat. No. 6,304,164, has a laminated structure as shown in FIG. 4, for example. That is, a coil is formed by laminating a plurality of magnetic material sheets 7*a* and 7*b* having internal conductor patterns 4*a* and 4*b* shaped like a letter L thereon, and then connecting the internal conductors 4*a* and 4*b* through via holes 8*a* and 8*b* into the shape of a spiral. Further, both ends of the coil formed by the internal conductor patterns 4*a* and 4*b* are connected to via holes 8*c* and 8*d* formed in a plurality of laminated magnetic material sheets 7*c* and 7*d*, respectively.

Thereby, lead conductor portions are formed by coupling a plurality of via holes 8*c* and 8*d*. The via holes 8*c* and 8*d* exposed to the surfaces of the magnetic material sheets 7*c* and 7*d* placed at both ends are connected to the external terminal electrodes 5*a* and 5*b*. These external terminal conductors 5*a* and 5*b* are formed on the both end faces along the length of the chip and on portions of the faces adjacent to these end faces.

In the conventional multi-laminated chip inductors 6 of the longitudinal stack type described above, the external terminal electrodes 5*a* and 5*b* are formed on both end faces along the chip length in which are perpendicular to the winding center-line of the coil formed by internal conductors 4.

Therefore, when the magnetic flux generated by the passage of electric current through the coil passes through the external terminal electrodes 5*a* and 5*b*, eddy current is generated within the external terminal electrodes 5*a* and 5*b*. This eddy current has been one of the factors that increase its electrical loss.

Further, as the internal conductors 4 and the external terminal electrodes 5*a* and 5*b* are disposed nearly parallel to each other, stray capacity is produced between them. This stray capacity has been one of the factors behind a reduction in the self-resonance frequency of the inductors.

Also, in manufacturing of multi-laminated chip inductors of the longitudinal stack type described above, there has been no approach for adjusting a value of inductance except re-designs such as changing the core area. It has been also necessary to change the content of design for each different value of inductance. Thus, the control of design specification has been very complex.

BRIEF SUMMARY OF THE INVENTION

Considering the problems described above, it is an objection of the present invention to provide a multi-laminated inductor and a method for manufacturing it which allow reducing eddy current generated within an external terminal electrode and further an easy adjustment/modification of a value of inductance.

In order to achieve the objective described above, by providing a lead layer having a lead internal conductor exposed to a chip surface nearly parallel to the winding center-line of a coil and connected to an end of the coil for a predetermined layer, and forming an external terminal electrode formed on a face nearly parallel to the winding center-line of the coil and connected to the lead internal conductor, a multi-laminated inductor having the chip with a laminated structure having the coil buried therein and the external terminal electrode formed on the chip surface and connected to the coil is configured.

According to this multi-laminated inductor, the external terminal electrodes are formed on the faces parallel to the winding center-line of a coil, so that the magnetic flux generated by the passage of electric current through the coil does not intersect the external terminal electrodes surface. Thus, eddy current within the external terminal electrodes is prevented from generating, and so increasing the loss generated by the eddy current can be suppressed.

Also, by providing a lead internal conductor exposed to all the faces parallel to the winding center-line of a coil, it is not necessary to select a face having the external terminal electrode exposed therein at the production of the coil, so that the manufacturing process can be simplified.

Also, according to the invention , the multi-laminated inductor described above is provided with a chip shaped like a rectangular solid which has square-shaped insulating material sheets laminated therein and further provided with a lead layer comprising an insulating material sheet having a first lead internal conductor formed thereon and an insulating sheet having a second lead internal conductor formed thereon; wherein the first lead internal conductor is formed like a cross shape with a predetermined width and has its intersection point at the center of the insulating material sheet and their four edges reach to the four edges of the insulating material, and the second lead internal conductor is formed like a linear shape with a predetermined width and placed so that one end thereof is connected to the first lead internal conductor nearly at the center of the insulating material sheet and the other end thereof is connected to a predetermined spot of the end of the coil.

According to this multi-laminated inductor, the coil and the external terminal electrode are electrically connected by means of the first and second lead internal conductors. Since these first and second lead conductors are formed like a cross and linear shape respectively, the area intersecting the magnetic flux generated by the coil can minimized, and so eddy current within the first and second internal conductors can be prevented from generating.

Further, the chip is shaped like a rectangular solid and the insulating material sheets are shaped like a square, and further the first lead internal conductor is exposed to the four surfaces of the chip which are parallel to the winding center-line of the coil. Therefore, even when the external terminal electrode is formed on any face of the four surfaces, the same multi-laminated inductor may be obtained. Further, by forming a second lead internal conductor at varied position in the production of the coil, the position of connection between the second lead internal conductor and an end portion of the coil can be changed. Thus, the value of inductance can be easily changed.

Also, according to the invention, the multi-laminated inductor described above is provided with a rectangular solid-shaped chip having square-shaped sheets of insulating material laminated and further provided with a lead layer made of an insulating material sheet having a first lead internal conductor formed thereon and an insulating sheet having a second lead internal conductor formed thereon, wherein the first lead internal conductor is formed along a diagonal of the insulating material sheet and both ends thereof each are formed like a linear shape with a predetermined width extending over two sides, the second lead internal conductor being formed like a linear shape with a predetermined width and being placed so that one end thereof may be connected to the first lead internal conductor nearly at the center of the insulating material sheet and the other end thereof may be connected to a predetermined spot of the end of the coil.

This multi-laminated inductor has the first and second lead internal conductors establishing an electrical connection between an end of the coil and an external terminal electrode. Since these first and second lead internal conductors are formed like a linear shape, the area intersecting the magnetic flux generated by the coil can be minimized. Thus, Eddy current can be prevented from generating within the first and second lead internal conductor. Also, the chip is shaped like a rectangular solid and the insulating material sheets are shaped like a square, and the first lead internal conductor is exposed to the four chip surfaces parallel to the winding center-line of the coil. Therefore, even when the external terminal electrode is formed on any one of the four surfaces, the same multi-laminated inductor can be obtained. Further, by forming the second lead internal conductor at a varied position in the manufacturing, the second lead internal conductor can be connected to the varied end of the coil. Thus, the value of inductance can be easily varied.

Also, according to the invention, in the multi-laminated inductor described above, the external terminal electrodes are disposed at both end portions along the winding center-line and portions thereof are continuously spread over the peripheries of the adjoining faces.

As this multi-laminated inductor can provide a long distance between two external terminal electrodes, when mounted on a board it can reduce the stress produced at the external terminal electrodes due to the bending of the board. Thus, the occurrence of connection failure between the electrodes on the board and the external terminal electrodes can be reduced.

Further, according to the invention, the multi-laminated inductor described above is provided with the external terminal electrodes formed on both end portions, along the winding center-line of a coil, in each of the two faces nearly parallel to the winding center-line of the coil and adjacent to the face which are opposed to a board surface when mounted on the board and parallel to an orbital centerline of the coil.

This multi-laminated inductor can provide a long distance between the external terminal electrodes which are formed on both end portions along the winding center-line of the coil. Therefore, when the inductor is mounted on a board, the stress produced at the external terminal electrodes due to the bending of the board can be reduced. Further, the multi-laminated inductor allows to be mounted on a board so that the external terminal electrodes may be perpendicular to the board surface. Pairs of the external terminal electrodes are disposed, respectively, on the two surfaces of the chip that are perpendicular to the board surface. Thus, at the time of reflow, the Manhattan phenomenon that a chip rises up can be prevented from occurring.

Also, according to the invention, the multi-laminated inductor is made of a coil having a winding layer having a coil conductor formed and a lead layer laminated outside the turn layer, and of external terminal electrodes formed on a chip surface nearly parallel to the winding center-line of the coil and connected to the lead internal conductors. When the multi-laminated inductor described above is manufactured, by changing the position where the lead internal conductor is disposed on the insulating material sheet making up the lead layer, the position where the lead internal conductor is connected to the coil end can be changed. Thus, the multi-laminated inductor of different inductance values can be obtained.

Further, in this manufacturing method, internal conductors shaped like a letter I, L or U and via holes to be connected to the end portion thereof are formed on insulating material sheets. Then, the winding layer is formed by laminating a plurality of these insulating material sheets so that the internal conductors may form a coil. Also, the lead layer comprises one or more insulating material sheets on each of which a lead internal conductor having one end thereof connected to a coil end and the other end thereof reaching to an edge of the sheet is formed.

According to this manufacturing method of the multi-laminated inductor, by changing the position where the lead internal conductor is connected to a coil end, there is made a portion of the coil end which does not function as a coil. Thus, inductance values can be changed.

Further, in the manufacturing method described above, only changing the position to form the lead internal conductor allows a change or adjustment of the value of inductance. Therefore, at the time of manufacturing, only the preparation of insulating material sheets having the lead internal conductor formed at a varied position allows easy manufacturing of the multi-laminated chip inductors with a different value of inductance, without changing the outside shape and the position of the external terminal electrodes.

Therefore, the adjustment of an inductance value does not require extensive redesigns such as changing the core area as previously needed. Further, it is not necessary extensively to change the content of design for each different value of inductance. Thus, it is very simple to control the design specification.

Also, in the manufacturing method for the multi-laminated inductor described above, an internal conductor making up a coil end and at least a portion of a lead internal conductor are opposed and connected to each other without existence of the insulating material sheet between them. For this, an insulating material sheet having a lead internal conductor or an internal conductor making up the coil end formed thereon is laminated on the other insulating material sheet with reverse from top to bottom so that the structure described just above may be obtained.

According to this manufacturing method, when the inductance value is varied by changing the position to form the lead internal conductor, even in cases where two or more insulating material sheets require some modification such as through-hole machining, this variation is possible only by changing one insulating material sheet having the lead internal conductor formed. That is, an insulating material sheet having a lead internal conductor or an internal conductor making up the coil end formed thereon is laminated on the other insulating material sheet with reverse from top to bottom.

BRIEF DESCRIPTION OF THE DRAWINGS

FIG. 8*a* to 8*g* are illustrations of the relation between the positions of lead internal conductors of the first embodiment of the invention and the inductance values;

FIG. 9 is a diagram showing the lead internal conductors of the first embodiment of the invention chip surfaces;

FIG. 10 is a diagram showing other shapes of the lead internal conductors of the first embodiment of the invention;

FIG. 11 is a diagram showing other exposure situation where the chip surface, of the lead internal conductors of the first embodiment of the present invention is exposed to chip surfaces;

FIG. 12 is a diagram showing a laminated structure of a second embodiment of the invention;

FIG. 13*a* to 13*g* are illustrations of the relation between the positions of lead internal conductors of the second embodiment of the invention and inductance values;

FIG. 14 is a diagram showing a laminated structure of a multi-laminated chip inductor according to a third embodiment of the present invention;

FIG. 15 is a diagram showing a different example of external terminal electrode formation of an embodiment of the invention;

FIG. 16 is a diagram showing a different example of external terminal electrode formation of an embodiment of the invention;

FIG. 17 is a diagram showing a different example of external terminal electrode formation of an embodiment of the invention;

FIG. 18 is an illustration of the exposure position of an end of the lead internal conductor related to a different example of the external terminal electrode formation of an embodiment of the present invention;

FIG. 19 is an illustration of the exposure position of an end of the lead internal conductor related to a different example of the external terminal electrode formation of an embodiment of the present invention;

FIG. 20 is an illustration of the exposure position of an end of the lead internal conductor related to a different example of the external terminal electrode formation of an embodiment of the present invention;

FIG. 21 is an illustration of inductance when the multi-laminated chip inductor of an embodiment of the invention is mounted on a parent circuit board;

FIG. 22 is an illustration of inductance when the multi-laminated chip inductor of an embodiment of the invention is mounted on a parent circuit board;

FIG. 25 is an illustration of inductance when the multi-laminated chip inductor of an embodiment of the invention is mounted on a parent circuit board;

FIG. 26 is a diagram showing a different example of the lead internal conductor formation according to an embodiment of the invention;

FIG. 27 is a diagram showing a different example of the lead internal conductor formation according to an embodiment of the invention;

FIG. 28 is a diagram showing a different example of the lead internal conductor formation according to an embodiment of the invention.

DETAILED DESCRTPTION OF THE INVENTTON

The details of the present invention will be explained with reference to the appended drawings.

Figure 1:
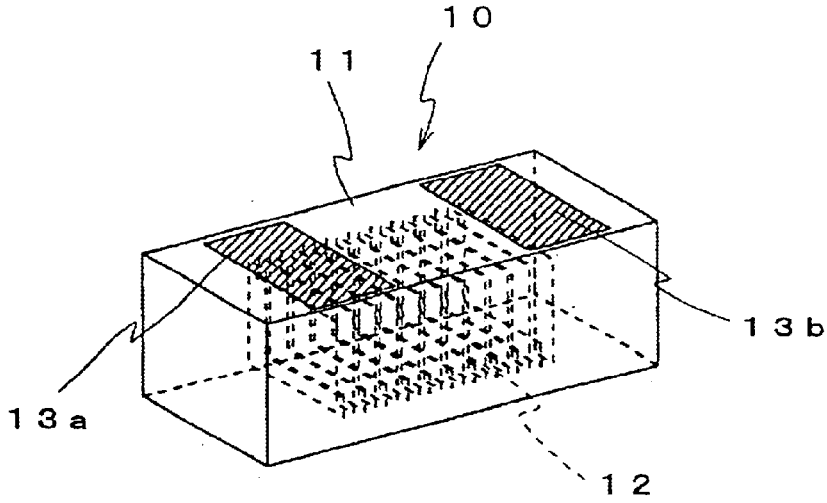
FIG. 1 is a perspective diagram showing a multi-laminated chip inductor of a first embodiment of the invention.
Figure 2:
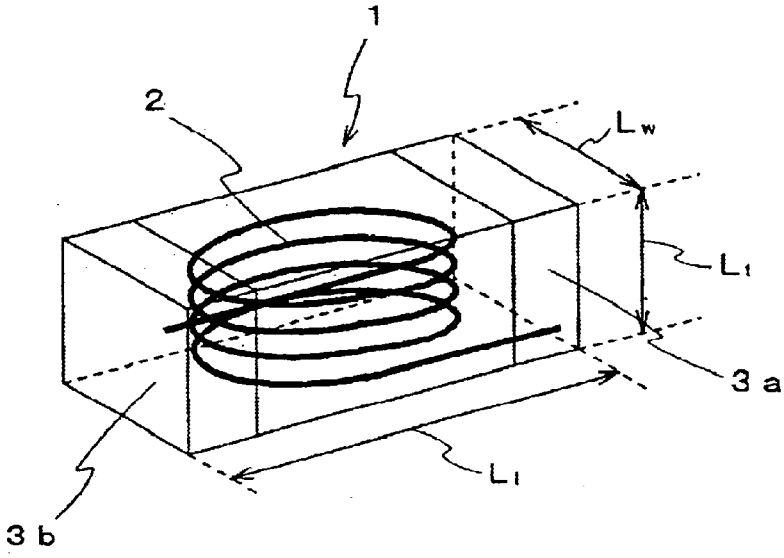
FIG. 2 is a perspective diagram showing a typical example of a conventional multi-laminated chip inductor.
Figure 3:
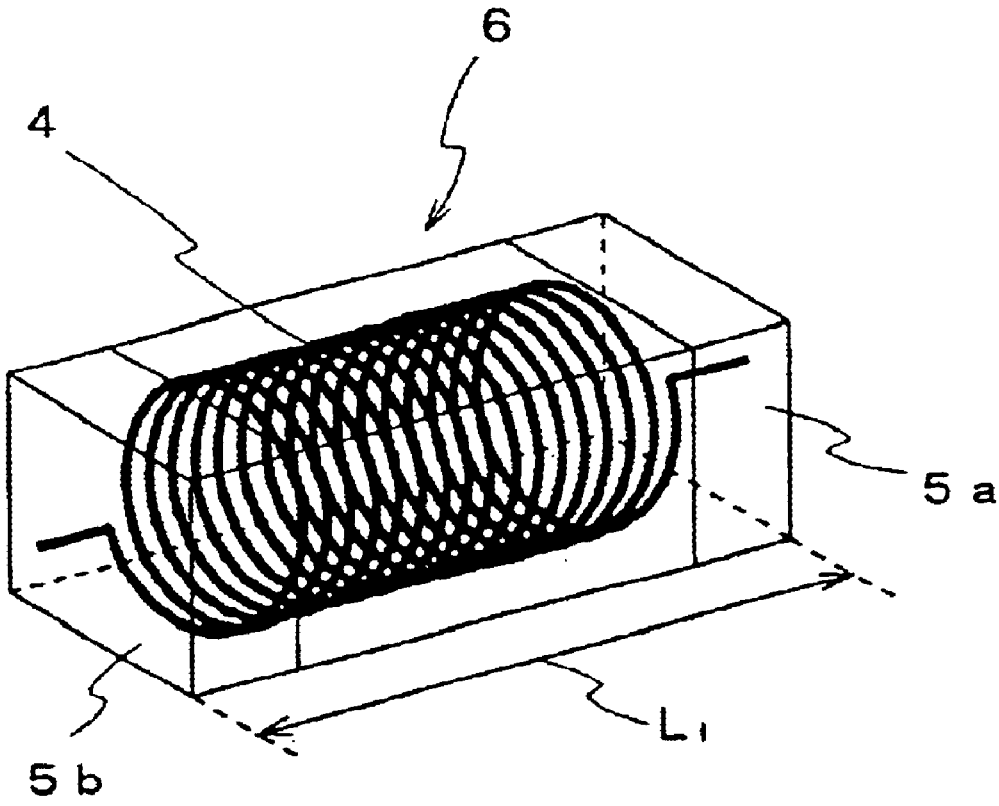
FIG. 3 is a perspective diagram showing a longitudinal stack type of a multi-laminated chip inductor.
Figure 4:
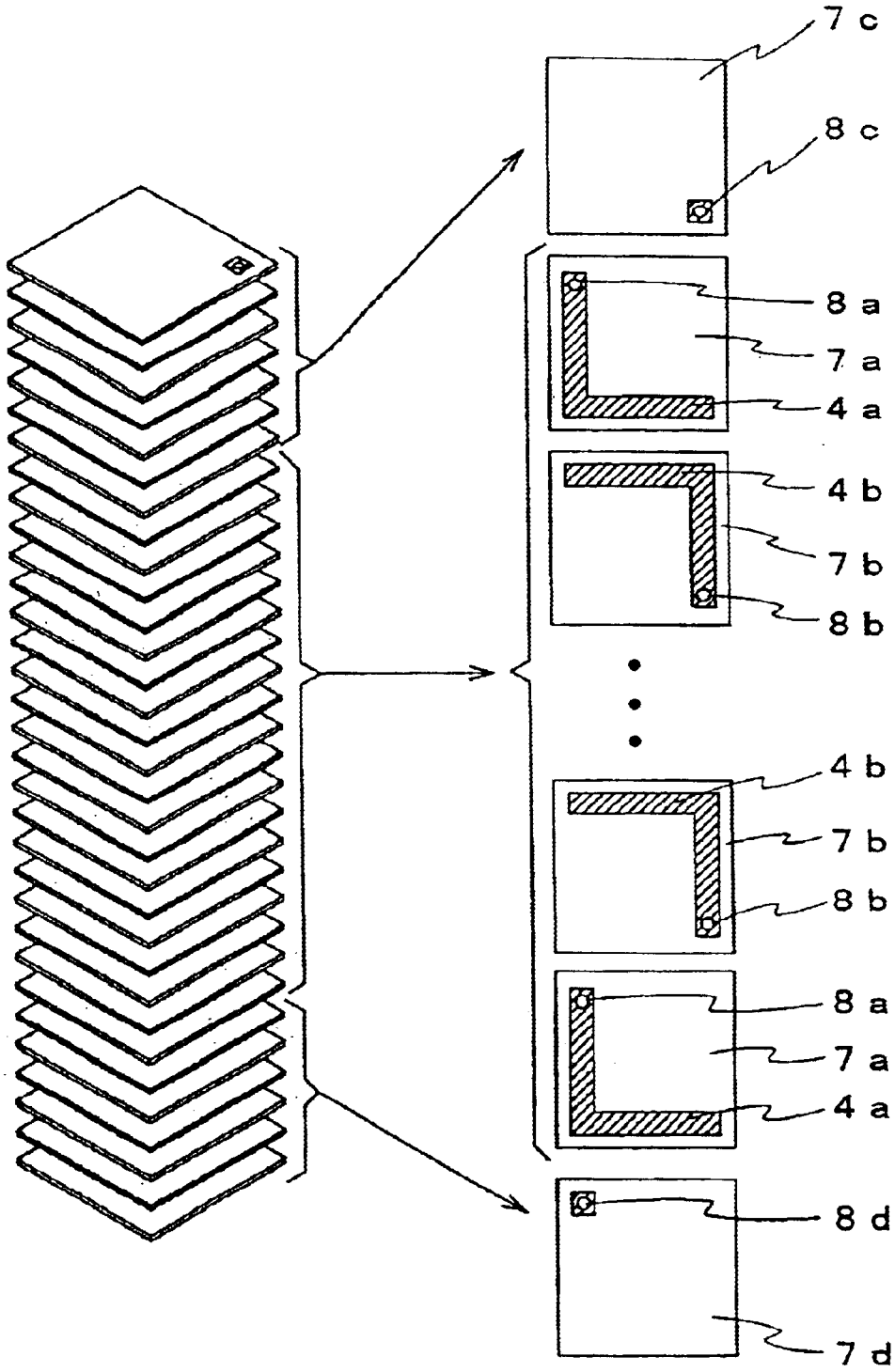
FIG. 4 is a representation of a laminated structure of an example of a longitudinal staked type of a multi-laminated chip inductor, similar to that described in previously mentioned U.S. Pat. No. 6,304,164.
Figure 5:
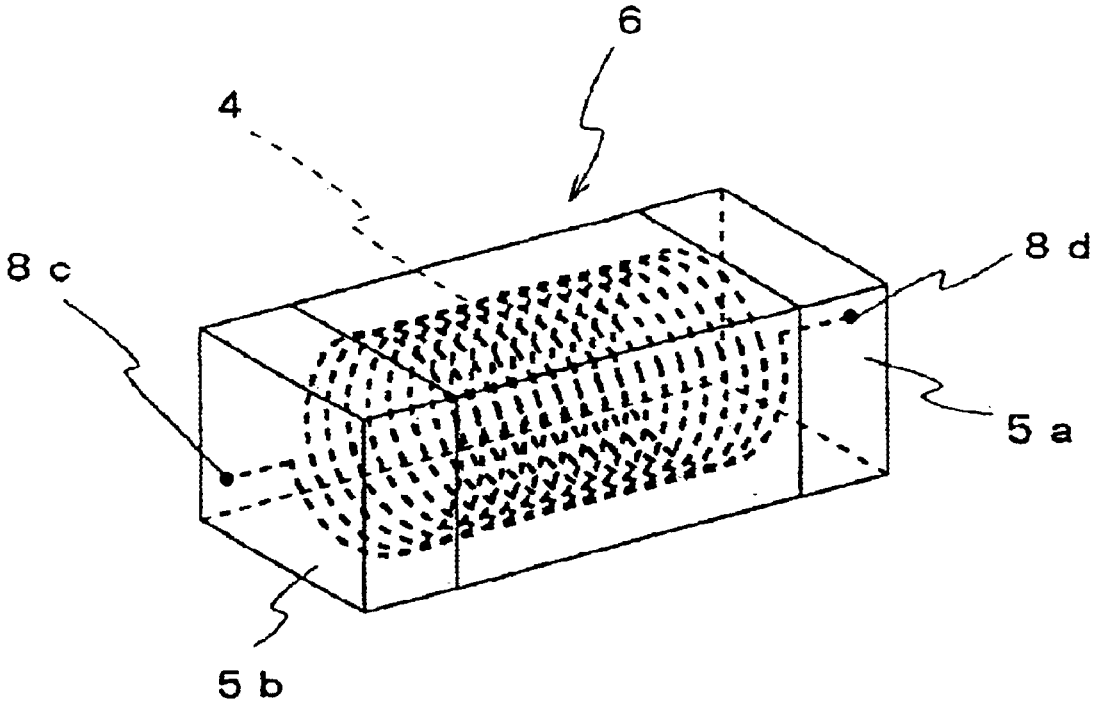
FIG. 5 is a diagram illustrating problems of conventional types.
Figure 6:
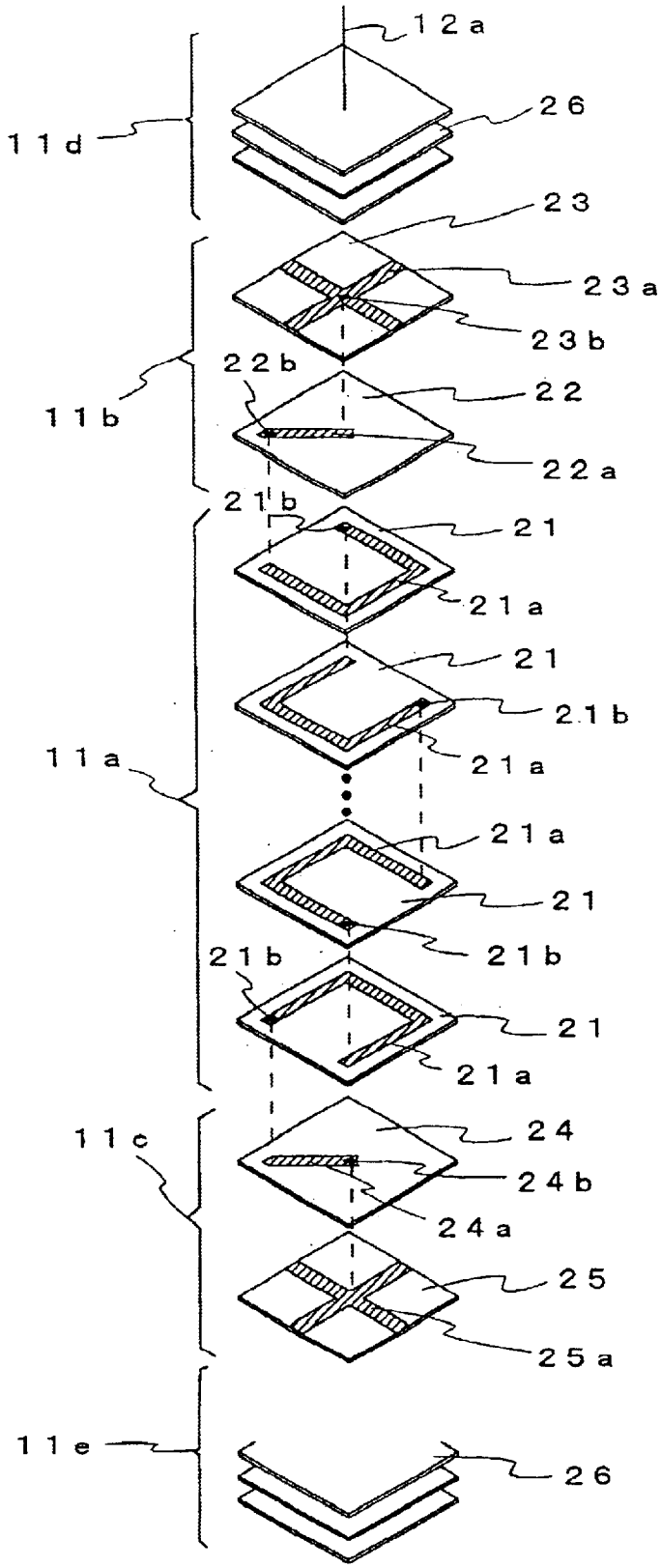
FIG. 6 is a diagram showing a laminated structure of a multi-laminated chip inductor of the first embodiment of the invention.
Figure 7:
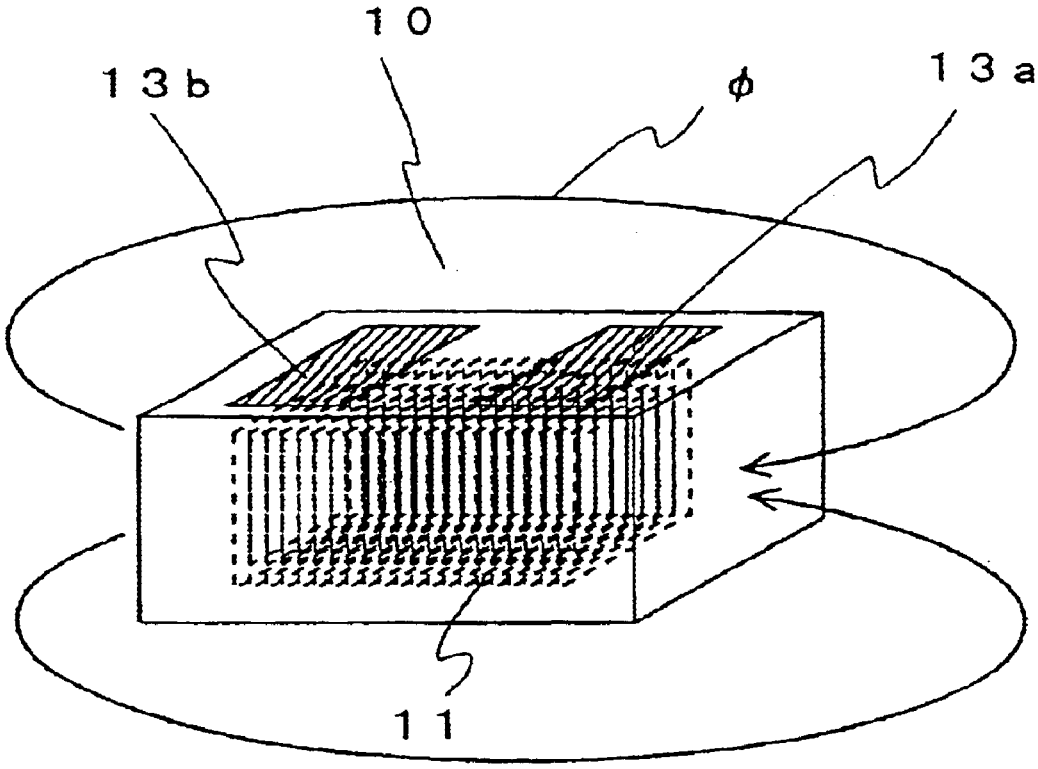
FIG. 7 is a diagram showing the relation between external terminal electrodes of the first embodiment of the present invention and the magnetic flux.

FIG. 1 is a schematic perspective diagram of a multi-laminated chip inductor 10 according to a first embodiment of the invention and FIG. 6 is an illustration of a laminated structure thereof. Referring to FIG. 1, a chip 11 has the geometry of a rectangular solid with a laminated structure made of an electrically insulating magnetic or non-magnetic material. A coil 12 is formed to be internal conductors which are buried in the chip 11, and connected in a helical shape. Also, external terminal electrodes 13*a*, 13*b* are formed on the same chip surface parallel to the center line 12*a* of windings of the coil 12.

Here, the coil 12 is formed so that its winding center-line 12 may extend along the direction of laminating in the laminated structure of the chip 11.

The chip 11, as shown in FIG. 6, is formed by laminating two or more sheets 21 to 26 of insulating material with a predetermined thickness having the geometry of a square.

In the following explanation, the insulating material sheets 21 to 26 are assumed to be laminated along the up-and-down direction corresponding to FIG. 6.

That is, the chip 11 comprises a winding layer 11*a*, lead layers 11*b* and 11*c*, and dummy layers 11*d* and 11*e*.

The winding layer 11*a* is a layer for forming the coil 12. This winding layer 11*a* is formed by laminating a plurality of square insulating material sheets 21, which have on its top an internal conductor 21*a* shaped like a letter U having a via hole 21*b* at one end thereof filled with a conductor. When these insulating material sheets 21 are laminated, one end of the internal conductor 21*a* on an upper layer is connected to the other end of the conductor 21*a* on the adjoining lower layer through a conductor in the via hole. Thus, the internal conductors 21*a* formed on two or more layers makes the helical coil 12.

In the explanation below, a via hole filled with a conductor will be referred to simply as a via hole. It is assumed that "connected to a via hole" and "connected by a via hole" mean "connect to the conductor filled in a via" and "connected by the conductor filled in a via," respectively.

The lead layer 11*b* is placed on the winding layer 11*a*. This lead layer 11*b* comprises an insulating material sheet 22 having a lead internal conductor 22*a* formed on its top and an insulating material sheet 23 having a lead internal conductor 23*a* formed on its top.

One lead internal conductor 22*a* has one end thereof positioned in the middle of the sheet 22 and the other end thereof disposed to connect to a via hole 22*b* formed at a predetermined position. The via hole 22*b* is connected to the other end of the internal conductor 21*a* on the highest layer of the winding layer 11*a*.

Further, the other lead internal conductor 23*a* is formed like a cross with a minimal width necessary for connecting to a via hole 23*b* formed in the middle of the sheet 23. The four ends of the conductor 23*a* reach to nearly the middle of the four sides of the sheet 23, respectively. Also, the via hole 23*b* is connected to the one end 22*c* of the lead internal conductor 22*a* described above.

Thereby, the lead internal conductor 23*a* is exposed to the four surfaces of the chip 11, respectively, having a linear shape with a predetermined length.

The lead layer 11*c*, placed under the winding layer 11*a*, comprises an insulating material sheet 24 having a lead internal conductor 24*a* formed on its top and an insulating material sheet 25 having a lead internal conductor 25*a* formed on its top.

Also, one lead internal conductor 24*a* is formed so that one end thereof may be connected to a via hole 24*b* formed in the middle of the sheet 24 and the other end thereof may be connected to a via hole 21*b* in the bottom layer of the winding layer 11*a*.

Further, the other lead internal conductor 25*a* is shaped like a cross which has its intersection in the middle of the sheet 25 and a minimal width necessary for connecting to the via hole 24*b* formed in the sheet 24. The four ends of the conductor 25*a* reach to the middle of the four sides of the sheet 25, respectively.

Thereby, the lead internal conductor 25*a* is exposed to the four surfaces of the chip 11, having a linear shape with a predetermined length.

Each of the dummy layers 11*d* and 11*e* is made of two or more insulating material sheets 26 that have no internal conductor formed. One dummy layer 11*d* is disposed on the lead layer 11*b* and the other dummy layer 11*e* is disposed under the lead layer 11*c*.

The multi-laminated chip inductor 10 described above does not have external terminal electrodes formed on both end faces along the chip length which are perpendicular to the winding center-line 12*a* of the coil 12. Therefore, a magnetic flux $\phi$ generated by the passage of electric current through the coil does not intersect the external terminal electrodes 13*a* and 13*b*. Thus, eddy current within the external terminal electrodes 13*a* and 13*b* can be prevented generating, so that electrical loss can be made less than conventional types.

Also, in the structure described above, the magnetic flux generated by the coil 12 intersects the lead internal conductors 22*a*, 23*a*, 24*a* and 25*a*. However, the areas of these lead internal conductors can be decreased to minimal areas required for conduction of electricity, so that the generation of eddy current is made extensively less than in previous types and the production of losses can be suppressed.

Further, the internal conductors 21*a* forming the coil 12 and the external terminal electrodes 13*a* and 13*b* are disposed so that their respective planes may be perpendicular to each other. Therefore, the stray capacity between them is extensively reduced when compared to conventional types, so that a decrease in self-resonance frequency can be suppressed.

Also, in the multi-laminated chip inductor 10*a* of the structure described above, the inductance values corresponding to 0 through ¾ turn can be easily varied by changing the connection position between the lead internal conductor layer 22*a* and the internal conductor 21*a* of the highest layer in the winding layer 11*a*.

For example, when the via hole 22*b* formed at the other end of the lead internal conductor 22*a* is matched to the other end 21*c* of the internal conductor 21*a* on the highest layer of the winding layer 11*a*, as shown in FIG. 8*a*, a maximum inductance in the structure described above can be obtained.

Also, various inductance values can be obtained by positioning the via hole 22*b* formed at the other end of the internal conductor 22*a* to the various positions as shown in FIG. 8*b* to 8*g*. The structure as shown in FIG. 8*b* reduces inductance by a inductance value corresponding to ⅛ turn. Also, The structures of FIGS. 8*c*, 8*d*, 8*e*, 8*f* and 8*g* provide decreases corresponding to ¼ turn, ⅜ turn, ½ turn, ⅝ turn and ¾ turn, respectively.

Thus, only by preparing various insulating material sheets 22 with the lead internal conductor 22*a* formed at different positions at the time of manufacturing, different values of inductance can be manufactured without the need for changing the outside shape and the formation position of the external terminal electrodes 13*a* and 13*b*.

Thus, concerning the production of the multi-laminated chip inductor described above, adjusting the value of inductance does not require extensive re-designs such as changing core areas, though needed for conventional types, and further extensively changing the content of design is not necessary for each different value of inductance. Therefore, it is very simple to control design specification and so on.

Further, it is also possible to change the value of inductance in the same way by changing both the formation position of the lead internal conductor 24*a* and the formation position of the via hole 21*b* in the insulating material sheet 21 of the lowest layer in the winding layer 11*a*. However, in this case, it is necessary to vary two insulating material sheets.

Next, the method for manufacturing the multi-laminated chip inductor described above will be explained.

First, green-sheets are made of slurry composed of low-temperature burning insulating materials by using the doctor blade method.

Further, the via holes described above are formed at the necessary positions of the green-sheets. Then, a conductor paste including silver as a major constituent is printed on the green-sheets described above with a predetermined pattern by using screen-printing so that the via holes described above maybe filled with the paste. After that, the printed green-sheets are laminated so that conductor pastes can be bonded to each other through the via holes for forming the coil 12.

Still, at the time of manufacturing, internal conductors corresponding to two or more multi-laminated chip inductors are formed on one green-sheet, and two or more green-sheets having internal conductors formed are laminated in the same way. Thus, two or more multi-laminated chip inductors are made at the same time.

Next, the laminated assembly described above is made into a single body by thermocompression bonding.

After the body is cut and separated into each individual multi-laminated chip inductor, the chip inductors are heated in the atmosphere to remove binder from the green-sheets (binder removing treatment) and then are burned at 900° C. for 1 hr in the atmosphere.

As shown in FIG. 9, the burned product (chip 11) obtained by this process has the ends of the lead internal conductors 23*a* and 25*a* exposed respectively in the four chip surfaces almost parallel to the winding center-line 12*a* of the coil 12.

An electrode paste including glass-frit having silver as a major constituent are printed on the burned product by using screen printing and baked, so that the external terminal electrodes 13*a* and 13*b* electrically connected to the exposed portions of the lead internal conductors 23*a* and 25*a* are formed.

Further, the external terminal electrodes 13*a* and 13*b* are plated with nickel and solder. Thus, the multi-laminated chip inductor is completed.

Here, the lead internal conductors 23*a* and 25*a* are exposed to the four surfaces of the chip 11, respectively. Therefore, when a pair of the external terminal electrodes 13*a* and 13*b* described above is formed in the same surface of the chip 11, it is not necessary to select a direction of the chip 11. Thus, the productivity can be improved.

The shape of the lead internal conductor exposed to the surfaces of the chip 11 is not limited to a cross-like shape described above. For example, as a substitute for the cross-shape lead internal conductor, use of lead internal conductors 23*a*' and 25*a*' as shown in FIG. 10 can achieve the same effect.

That is, lead internal conductors 23*a*' and 25*a*' with a predetermined width are formed along a diagonal line on the top of the sheets 23 and 25. Thereby, each of the lead internal conductors 23*a*' and 25*a*' has both ends which are spread over both of two adjoining sides and exposed to the four surfaces of the chip 11, respectively, in the shape of a linear geometry with a predetermined length.

Therefore, at the time of manufacturing, for forming external terminal electrodes 13*a* and 13*b*, it is not necessary to select a direction of the chip. Thus, productivity can be improved.

Next, a second embodiment of the invention will be explained.

FIG. 12 is an illustration of a multi-laminated structure of a multi-laminated chip inductor according to a second embodiment, and it has the same appearance as the first embodiment as shown in FIG. 1.

Referring now to FIG. 12, the same components as the first embodiment described above are shown by the same reference sign and so their explanation will be omitted. Also, the difference between the first embodiment and the second embodiment is as follows. That is, an internal conductor 21*a*' of the lowest layer in the winding layer 11*a* may be formed on the bottom surface of the insulating material sheet 21. With laminating this sheet 21 with downward internal conductor 21*a*', the inductance value can be easily changed in the range of inductance corresponding to 0 through ¾ turn by changing the placement of the lead internal conductor 24*a*.

That is, as shown in FIG. 12, the internal conductor 21*a*' of the lowest layer in the winding layer 11*a* is formed like a letter U on the bottom surface of the insulating material sheet 21. Here, a via hole 21*b* formed at one end of the internal conductor 21*a*' is formed so as to connect to a via hole 21*b* formed in the next higher insulating material sheet 21. Further, it is needless to say that the internal conductor 21*a*' is disposed to connect with other internal conductor 21*a* of the winding layer 11a for forming the coil 12.

Further, the lead internal conductor 24*a* of the lead layer 11*c* has the other end connected to a predetermined spot of the internal conductor 21*a'*.

Figure 13G:
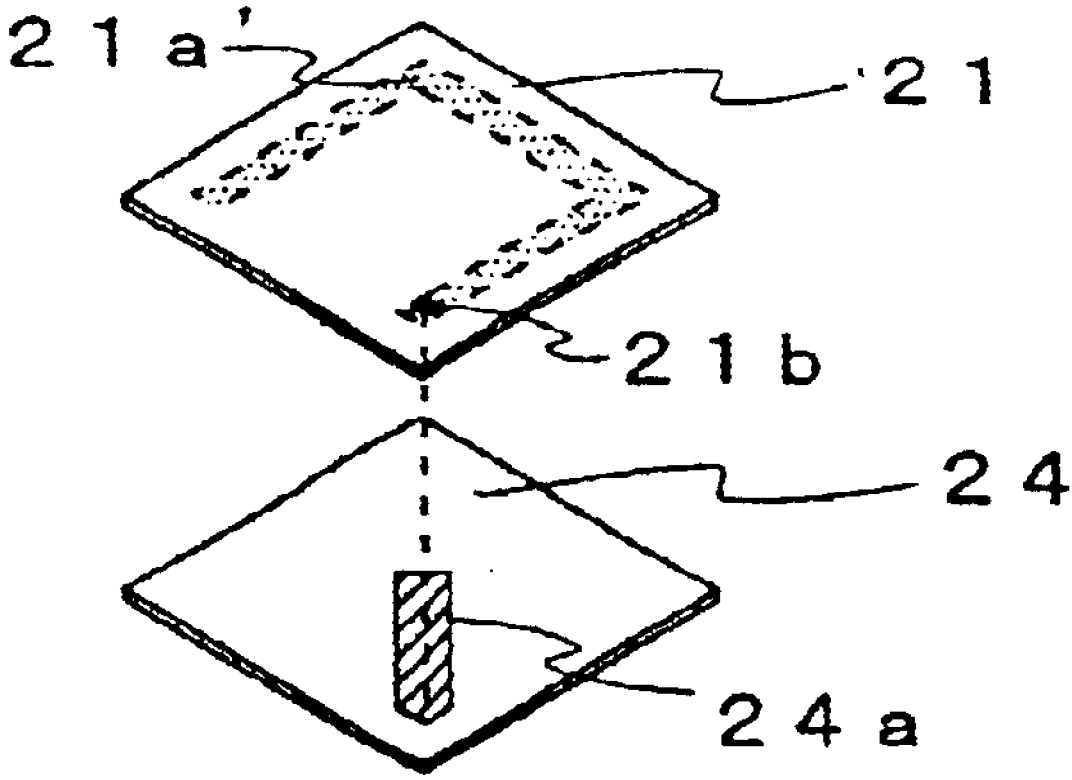

According to the structure described above, when the position of the other end of the lead internal conductor 24*a* is matched to the other end 21*c*' of the internal conductor 21*a*' of the lowest layer in the winding layer 11*a* as shown in FIG. 13, the decrease of inductance caused by the formation position of the lead internal conductor 24*a* is 0 when compared to the first embodiment.

Also, by forming the lead internal conductors 24*a* so that the other end of the conductors 24*a* may be disposed at the positions as shown in FIGS. 13*b* to 13*g*, various values of inductance can be obtained as follows. For the structure of FIG. 13*b*, an inductance value corresponding to ⅛ turn is reduced. For the structures of FIGS. 13*c*, 13*d*, 13*e*, 13*f* and 13*g*, inductance values corresponding to ¼ turn, ⅜ turn, ½ turn, ⅝ turn and ¾ turn are reduced, respectively.

Thereby, at the time of manufacturing, only by preparing insulating material sheets 24 with the lead internal conductors 24*a* formed at different positions, it is possible to manufacture multi-laminated chip inductors with various value of inductance. Also, without changing the outside shape and the formation position of the external terminal electrodes 13*a* and 13*b*, the inductance values in the range corresponding to 0 through 3½ turn can be easily varied in accordance with the variable amount of inductance corresponding to the formation position of the lead internal conductor 22*a*.

Thus, concerning the manufacturing of the multi-laminated chip inductor described above, extensive re-designs such as changing the core area, needed by conventional types, is not required for adjusting the value of inductance, and further it is not necessary to extensively change design for each of different values of inductance. It is very simple to control design specification.

Further, it is needless to say that the second embodiment can obtains the same effect as the first embodiment.

Next, the third embodiment of the invention will be explained.

FIG. 14 is an illustration of a laminated structure of a multi-laminated chip inductor according to a third embodiment, and it has the same appearance as the first embodiment.

Also, in FIG. 14, the same components as the second embodiment described above are shown by the same reference signs, and the explanation of them will be omitted.

Further, the difference between the second and third embodiments is in the changed structure of the lead layers 11*b* and 11*c*.

That is, the lead layer 11*b* is made of an insulating material sheet 27 shaped like a square with a predetermined thickness which has a lead internal conductor 27*a* with a predetermined width in the shape of a linear geometry disposed on the bottom surface thereof. This lead internal conductor 27*a* is formed so as to have one end reaching to an edge of the insulating material sheet 27 and a minimum length required for the other end to be connected to a predetermined position of the opposite internal conductor 21*a*.

Also, the lead layer 11*c* is made of an insulating material sheet 28 shaped like a square with a predetermined thickness. Further, the sheet 28 has a lead internal conductor 28*a* with a predetermined thickness in the shape of a linear geometry disposed on the top surface thereof. This lead internal conductor 28*a* is shaped to minimum length so that one end thereof may reach to the edge of the insulating material sheet 28 at the same side as the one end of the lead internal conductor 27*a*, and the other end thereof may be connected to a predetermined spot of the opposite internal conductor 21*a*′.

According to the multi-laminated chip inductor described above, the external terminal electrodes 13*a* and 13*b* are not formed on both faces along the chip length perpendicular to the winding center-line 12*a* of the coil 12. Therefore, the magnetic flux $\phi$ generated by the passage of electric current through the coil does not intersect the external terminal electrodes 13*a* and 13*b*, so that electrical loss can be made less than conventional types.

Further, the internal conductors 21*a* forming the coil and the external terminal electrodes 13*a* and 13*b* are disposed so that their respective planes may be perpendicular to each other. Therefore, the stray capacity between them is extensively reduced when compared to conventional types, so that a decrease in self-resonance frequency can be suppressed.

Still further, in the structure described above, since the lead internal conductors 27*a* and 28*b* are formed on the periphery of the insulating material sheets 27 and 28, the magnetic flux generated by the coil does not almost intersect with the lead internal conductors 27*a* and 28*a*. Thus, the generation of eddy current can be reduced when compared to the first and second embodiments, and so electrical loss can be suppressed.

Also, by changing the connection position between the lead internal conductor 27*a* and the internal conductor 21*a* of the highest layer in the winding layer 11*a*, or the connection position between the lead internal conductor 28*a* and the internal conductor 21*a* of the lowest layer in the winding layer 11*a*, it is easy to change the inductance value in the range corresponding to 0 through ½ turn.

Thereby, only by preparing various insulating material sheets 27 and 28 having the lead internal conductor 27*a* and 28*a* formed at different positions at the time of production, different values of inductance can be easily produced without the need for changing the outside shape and the formation position of the external terminal electrodes 13*a* and 13*b*.

Thus, in the production of the multi-laminated chip inductor described above, adjusting the value of inductance does not require extensive re-designs such as changing core areas, needed by conventional types, and further extensive change of the design content is not necessary for each different value of inductance. Therefore, it is very simple to control design specification and so on.

Still, the multi-laminated chip inductor of the second embodiment is not limited to the structure described above. For example, the multi-laminated chip inductors having the external terminal electrodes formed at the position as shown in FIGS. 15 through 17 can achieve the same effect described above.

The external terminal electrodes 14*a* and 14*b* of the multi-laminated chip inductor 10 as shown in FIG. 15 are connected to the lead internal conductors which are exposed to the same surface parallel to the winding center-line 12*a* of the coil 12. Further, the external terminal electrodes 14*a* and 14*b* are disposed on the both end portions along the length of this face and portions thereof covers continuously the peripheries of other three adjoining surfaces. Even this structure also can provide a long distance between the two external terminal electrodes 14*a* and 14*b*. Thus, when mounted on a board, this structure can reduce the stress produced between the external terminal electrodes 14*a* and 14*b* due to the bending of the board, so that the occurrence of poor connections can be reduced.

Also, the external terminal electrodes 15*a* and 15*b* of the multi-laminated chip inductor 10 as shown in FIG. 16 are connected to the lead internal conductors which are exposed to the same surface parallel to the winding center-line 12*a* of the coil 12. Further, the external terminal electrodes 15*a* and 15*b* are disposed on the both end portions along the length of this surface and portions thereof covers continuously the peripheries of the end faces along the length of the chip 11. Even this structure also can provide a long distance between the two external terminal electrodes 15*a* and 15*b*. Thus, when this structure is mounted on a board, the occurrence of poor connections due to the bending of the board can be reduced.

Also, the external terminal electrodes 16*a* and 16*b* of the multi-laminated chip inductor 10 as shown in FIG. 17 are connected to a lead internal conductor of one end side of the coil 12, and the external terminal electrodes 17*a* and 17*b* are connected to a lead internal conductor of the other end side of the coil 12. Further, these electrodes 16*a*, 16*b*, 17*a* and 17*b* are disposed in each of the two surfaces adjacent to the chip face facing the board on which the multi-laminated chip inductor 10 is mounted. That is, the external terminal electrodes 16*a* and 17*a* are disposed at both end portions along the chip length in the same surface, respectively, and the electrodes 16*b* and 17*b* are disposed on both end portions along the length in the surface opposed to this surface.

Even this structure also can provide a long distance between the external terminal electrodes on both end portions along the length of the chip. Thus, when this structure is mounted on a board, the occurrence of poor connections due to the bending of the board can be reduced. Further, a pair of the external terminal electrodes is so formed as to be perpendicular to the board on each of the both end portions along the length of the chip 11. Therefore, at the time of reflowing, the rising of the chip, namely Manhattan phenomenon, can be prevented.

Further, as shown in FIG. 17, the external terminal electrodes 16*a*, 16*b*, 17*a* and 17*b* are formed on each of the two faces adjacent to the chip face opposed to the parent board surface on which the chip is mounted. In this case, the placement of the lead internal conductors to be described below provides the nearly same value of inductance, even if the chip is mounted with a reverse direction from top to bottom.

For example, as shown in FIG. 18, two lead conductors 41 and 42 are disposed so that a distance between a position having one lead conductor 41 exposed (the connection position of the external terminal electrodes 16*a* and 17*a* and the top face of the chip may be made equal to the distance between the position having the other lead conductor 42 exposed (the connection position of the external terminal electrodes 16*b* and 17*b*) and the bottom surface of the chip.

By this placement of the lead conductors 41 and 42, the sum of the respective distances between the lead conductors 41 and 42 and the lands 31 and 32 becomes always a constant value (D0=D1+D2), even if either of the top and bottom faces of the chip 11 of FIG. 8 is opposed to the parent circuit board 30, as shown in FIG. 19 and 20.

Figure 23:
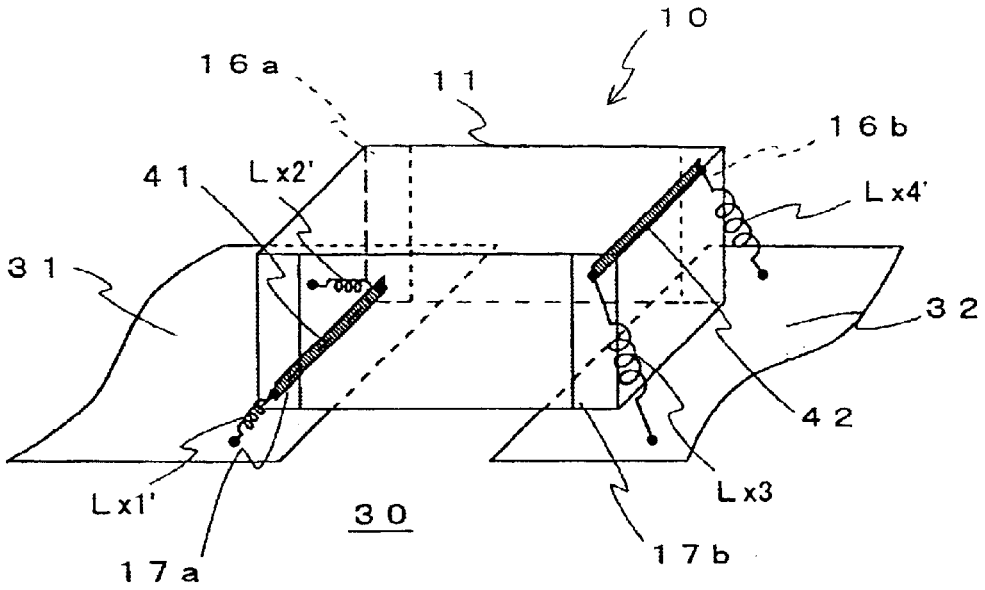
FIG. 23 is an illustration of inductance when the multi-laminated chip inductor of an embodiment of the invention is mounted on a parent circuit board.

In general, as shown in FIGS. 21 through 23, when the inductor 10 is mounted on a parent circuit board 30, the external terminal conductors 16*a*, 16*b*, 17*a* and 17*b* are soldered to lands 31 and 32. Then, inductances Lx1 through Lx4 are produced along the external terminal electrodes 16*a*, 16*b*, 17*a* and 17*b* due to the solder portions, respectively. These inductance values depend on the distances between the lands 31 and 32 and the exposed ends of the lead conductors 41 and 42. Therefore, as described above, the lead conductors 41 and 42 are disposed so that the sum of the respective distances from the exposed ends of the lead conductors 41 and 42 to the lands 31 and 32 can be always a constant value (D0=D1+D2). Thus, the sum of the inductances Lx1 through Lx4 is always a constant value. That is, the sum of the inductances Lx1 through Lx4 when the multi-laminated chip inductor 10 is mounted on the parent circuit board 30 as shown in FIG. 22 is equal to the sum of the inductance Lx1' through Lx4' when mounted with the reverse from top to bottom as shown in FIG. 23.

Figure 24:
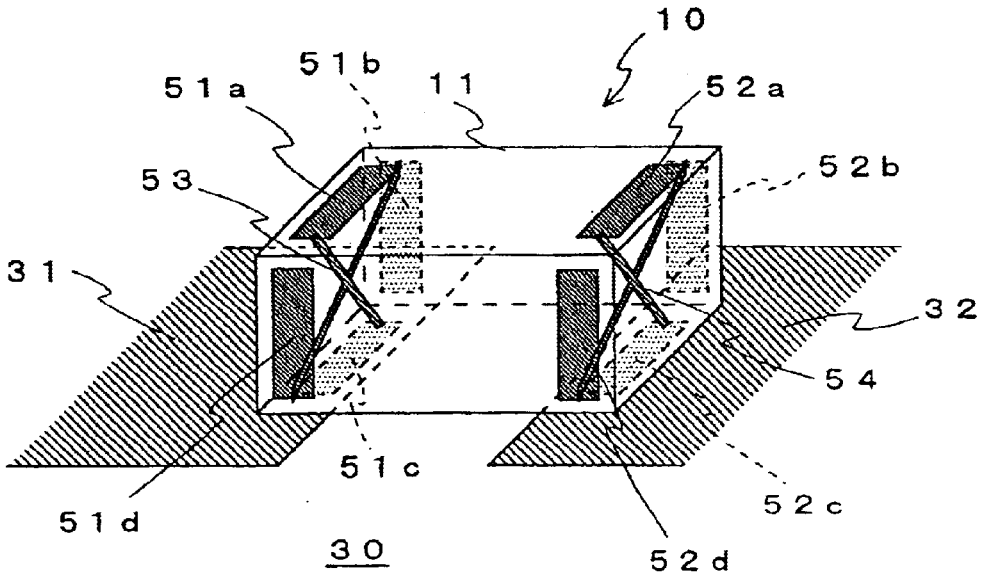
FIG. 24 is an illustration of a different formation position of the external terminal electrode and the exposure position of an end of the lead internal conductor according to an embodiment of the invention.

Also, as shown in FIG. 24, both end faces along the length of the chip 11 are shaped like a square and individual external terminal electrodes 51*a* through 51*d* are formed respectively on four side faces except these both end faces. Even when the external terminal electrodes 51*b*, 51*d*, 52*b* and 52*d* nearly perpendicular to the board face of a parent circuit board 30 are soldered to the lands 31 and 32, the lead internal conductors 53 and 54 are formed in the same described above. So, even if the multi-laminated chip inductor 10 is mounted with the reverse from top to bottom, the inductance value has only a slight variation.

That is, as shown in FIG. 25, the sum of the inductances Lx1 through Lx4 produced by soldering varies little whichever face of the chip 11 is downward when the multi-laminated chip inductor is mounted on the parent board 11.

Further, in the multi-laminated chip inductor of the first embodiment described above, as shown in FIG. 26, the lead internal conductors 22*a* and 24*a* shaped like a linear geometry and the lead internal conductors 23*a* and 25*a* shaped like a cross may be connected through via holes 61 made of a plurality of via holes connected in series. Such structure can increase the distance between the coil 12 and the lead internal conductors 23*a* and 25*a* shaped like a cross, and allows the external terminal electrodes 13*a* and 13*b* to be separated from the coil 12. Therefore, the stray capacity produced between the coil 12 and the external terminal electrodes 13*a* and 13*b* can be reduced.

Also, as shown in FIG. 27, an internal conductor 62*a* forming an end of the coil 12 is extended to an edge of an insulating material sheet 62. The edge portion 62*a* of the extended internal conductor is exposed to the surface of the chip 11 for use as a lead internal conductor 63. By this structure, it is also possible to form external terminal electrodes on a chip surface parallel to the winding center-line 12*a* of the coil 12. Thus, Eddy current generated in the external terminal electrodes can be reduced.

Further, as shown in FIG. 28, the lead internal conductors 64*a* and 64*b* is made thicker at their portions close to the surface. This increases the area of the conductors 64*a* and 64*b* exposed to the surface of the chip 11 and so improves connectivity with the external terminal electrodes 65*a* and 65*b*. In this case, to increase the thickness of the lead internal conductors 64*a* and 64*b*, two or more times coating of electrically conductive paste may be used when these conductors 64*a* and 64*b* are formed at the time of production.

Figure 29:
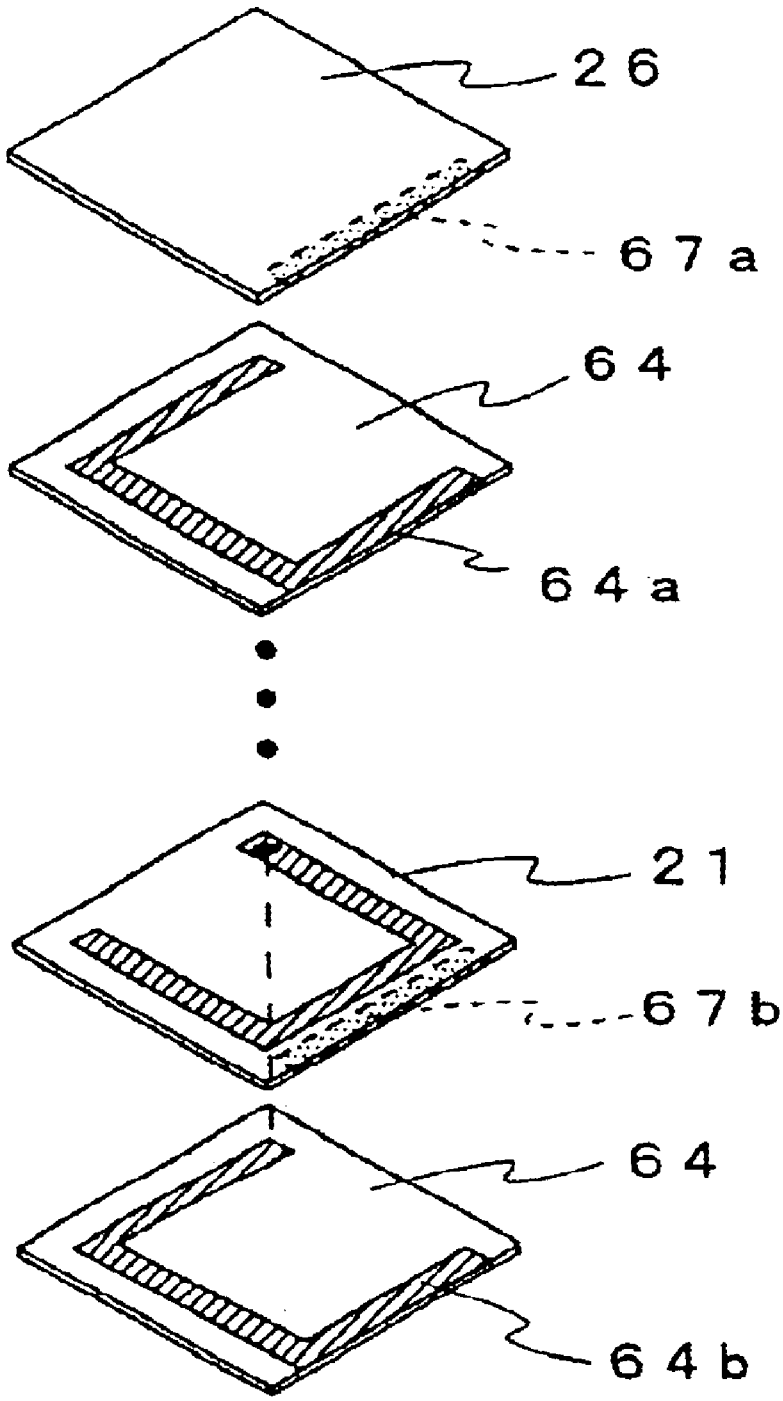
FIG. 29 is a diagram showing a different example of the lead internal conductor formation according to an embodiment of the invention.

Also, as shown in FIG. 29, lead internal conductors 67*a* and 67*b* are formed on the opposite face of the insulating material sheets 26 and 21 adjacent to the insulating material sheet 64 having the lead internal conductor 64*a* and 64*b*. And, the faces of these internal conductors are opposite to each other and connected to provide thicker conductors. These and other methods can be used to easily increase the thickness of the lead internal conductors.

Also, as a low-temperature burned insulating material used for the manufacturing of the multi-laminated chip inductor described above, magnetic materials such as Ni—Zn based ferrite et al. may be used. Further, as an internal conductor, other metals such as silver-palladium alloy, silver-platinum alloy, gold et al. may be used. In addition, metals other than silver may be used for the external terminal electrodes.

Also, the reverse-coater and others may be used for forming green sheets, and the slurry build method and others may be used as a method for laminating. The internal conductors may be formed by other methods such as transcription and sputtering.

Further, the external terminal electrodes may be formed by sputtering and other methods, and other metals may be used for plating them.

The descriptions described above of the conventional technology, means for solving problem, and description of the preferred embodiment are necessary and sufficient for explaining the content of the invention to persons skilled in the art.

Further, it is needless to say that the invention is not limited to the structures of the embodiments described above.

What is claimed is:

1. A method of forming first and second inductors having differing inductance values from two coils having identical properties except for connections of leads between ends of the coils and terminals for the inductors, each of the coils including (a) plural turns and (b) plural first insulating laminated sheets carrying connected internal conductors, both of the inductors including (c) at least one second insulating sheet laminated to the first sheets outside the internal conductor at an end turn of the coil, the second insulating sheet carrying an internal lead conductor connected to the internal conductor at the end turn of the coil, and (d) an external terminal electrode positioned so at least a portion thereof extends parallel to the coil axis, the method comprising:

exposing an end of an internal lead conductor on an exterior surface parallel to the coil axis of chip component, connecting the exposed end of the internal lead conductor to the external terminal electrode parallel to the coil axis, and establishing the connection between the internal lead conductor and the ends of the first and second coils of the first and second inductors at different first and second positions relative to the internal conductor at the end turn of the coil and the external terminal electrode of the first and second inductors.

2. The method of claim 1 wherein the internal conductor of the first and second inductors at the end of the coil has a U-shape in a plane at right angles to the coil axis, and the lead internal conductor of the first and second inductors extends from an edge of the second sheet inwardly in a plane at right angles to the coil axis, the connection for the first inductor between the lead internal conductor and the internal conductor at the end of the coil being established by positioning the second sheet of the first inductor so the lead conductor carried thereby extends at a first angle relative to the coil axis and contacts a first portion of the internal conductor at the end of the coil, the connection for the second inductor between the lead internal conductor and the internal conductor at the end of the coil being established by positioning the second sheet of the second inductor so the lead conductor carried thereby extends at a second angle relative to the coil axis and contacts a second portion of the internal conductor at the end of the coil.

3. The method of claim 1, wherein:

said second insulating material sheet having said lead internal conductor or said internal conductor at the coil end is laminated on an insulating sheet with reverse from top to bottom, and the internal conductors at the coil end and at least a portion of said lead internal conductor being opposed and connected to each other without any insulating sheet between them.

4. A method of forming first and second inductors having differing inductance values from two coils having identical properties except for connections of leads between ends of the coils and terminals for the inductors, each of the coils including (a) plural turns and (b) plural first insulating laminated sheets carrying connected internal conductors, both of the inductors including (c) at least one second insulating sheet laminated to the first sheets outside the internal conductor at an end turn of the coil, the second insulating sheet carrying an internal lead conductor connected to the internal conductor at the end turn of the coil, and (d) an external terminal electrode positioned so at least a portion thereof extends parallel to the coil axis, the method comprising establishing the connection between the internal lead conductor and the ends of the first and second coils of the first and second inductors at different first and second positions relative to the internal conductor at the end turn of the coil and the external terminal electrode of the first and second inductors, said second insulating material sheet having said lead internal conductor or said internal conductor at the coil end being laminated on an insulating sheet with reverse from top to bottom, and the internal conductors at the coil end and at least a portion of said lead internal conductor being opposed and connected to each other without any insulating sheet between them.

* * * * *